US007896709B2

(12) United States Patent
Nagamine

(10) Patent No.: US 7,896,709 B2
(45) Date of Patent: Mar. 1, 2011

(54) KEYED MATING CONNECTORS WITH LATCHING MECHANISM

(75) Inventor: Akira Nagamine, Miyoshi-cho (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 30 days.

(21) Appl. No.: 12/257,934

(22) Filed: Oct. 24, 2008

(65) Prior Publication Data

US 2009/0111313 A1 Apr. 30, 2009

(30) Foreign Application Priority Data

Oct. 24, 2007 (JP) ..... 2007-276603

(51) Int. Cl.
*H01R 13/64* (2006.01)

(52) U.S. Cl. ..... 439/680

(58) Field of Classification Search ..... 439/349, 439/352, 345, 370, 358, 751, 680
See application file for complete search history.

(56) References Cited

U.S. PATENT DOCUMENTS 5,011,426 A * 4/1991 Colleran et al. ..... 439/357
5,639,255 A * 6/1997 Muzslay ..... 439/347
5,643,003 A * 7/1997 Myer et al. ..... 439/352
2005/0215106 A1* 9/2005 Holub ..... 439/357
2009/0111308 A1* 4/2009 Nagamine ..... 439/328
2009/0111314 A1* 4/2009 Nagamine ..... 439/358

FOREIGN PATENT DOCUMENTS

JP 2006-202557 8/2006

OTHER PUBLICATIONS

U.S. Appl. No. 12/257,734, filed Oct. 24, 2008, Nagamine.
U.S. Appl. No. 12/257,946, filed Oct. 24, 2008, Nagamine.

* cited by examiner

*Primary Examiner*—Edwin A. Leon
*Assistant Examiner*—Vanessa Girardi
(74) *Attorney, Agent, or Firm*—Oblon, Spivak, McClelland, Maier & Neustadt, L.L.P.

(57) ABSTRACT

An electric connecting device of the present invention includes: a first connector having a first housing 22; a second connector having a second housing 42; and a metal latch 5. The first housing 22 has a cylindrical fitting 23, and the second housing 42 has a fitting receiver. On an exterior surface 23*s* of the fitting 23 are formed four ribs 24 each projecting in a radial direction of a center portion 23*c* of the fitting 23. An interior surface of the fitting receiver on the other hand has four recesses for respectively fitting therein the four ribs 24, during the connected state. The four ribs 24 includes two ribs 24 which are disposed across from each other over the center portion 23*c*, along a single line extending through the center portion 23*c*, when viewed from the connecting direction.

9 Claims, 16 Drawing Sheets

(e)

(d)

(a)

(b)

KEYED MATING CONNECTORS WITH LATCHING MECHANISM

CROSS REFERENCE TO RELATED APPLICATION

The present application claims priority from Japanese Patent Application No. 2007-276603, which was filed on Oct. 24, 2007, the disclosure of which is herein incorporated by reference in its entirety.

BACKGROUND OF THE INVENTION

1. Field of the Invention

The present invention relates to a latch-mountable connector housing and an electric connecting device, each of which is capable of reducing an effect from vibration.

2. Description of Related Art

Japanese Unexamined Patent Publication No. 2006-202557 (Tokukai 2006-202557; hereinafter Patent Document 1) discloses an example of known electric connector. In the electric connector, a metal latch, while being supported in a guide groove of a female housing, applies a preload to the female housing and a male housing, in a direction of fitting these housings with each other. A latch portion provided at a spring part of the metal latch fits in a fixing groove of the male housing, when the female and male housings are fit with each other. This structure realizes an electric connector capable of simply and easily providing a connection, while avoiding a loss in the electric conductivity even under a harsh environment.

SUMMARY OF THE INVENTION

In the electric connector described in Patent Document 1, the metal latch inhibits separation of the female and male housings from each other. When such an electric connector is adopted in a vehicle or the like, vibration from the engine or the like may affect the electric connector. If the housings of the electric connector are connected to each other with a gap therebetween, the housings may rattle with the vibration. Therefore, the housings may separate from each other, consequently disconnecting the electric connector, even though the metal latch is attached. Further, this vibration-attributed rattling of the housings may cause a damage to the housings due to abrasion.

A conceivable approach to reduce such an adverse effect from the vibration is, for example, to strengthen the resiliently-holding-force of the metal latch. This approach however requires modification of the shape of the metal latch such as thickening of the metal latch, and may enlarge or complicate the electric connector. On the other hand, it is preferable that the structure of the metal latch be made simple.

As a countermeasure against vibration, the electric connector of Patent Document 1 adopts a plurality of ribs in the male housing. In the female housing on the other hand are formed slits which are arranged to contact the ribs respectively. Specifically, on each of four side surfaces of the male housing formed in a box-like shape, a rib is formed in the middle portion. Further, one of the four side surfaces is provided with two more ribs, one of which is formed at one end of that side surface, and the other one of which is formed at the other end (cf. FIG. 4(a) of Patent Document 1). Further, each rib formed on each of the side surfaces projects in a direction normal to the side surface. Fitting these ribs on the male housing in the slits on the female housing reduces the gap between the both housings. Therefore, the both housings are restrained from rattling, thus achieving a reliable connection of the electric connector.

However, an increase in the number of ribs causes an increase in the size and weight of the electric connector, and the electric connector is more likely to be affected by vibration. In view of this, the electric connector is preferably simply structured with a less number of ribs.

Thus, it is an object of the present invention to provide a latch-mountable connector housing and an electric connecting device, each of which is simply structured and yet capable of maintaining the connected state while reducing an adverse effect from vibration.

To achieve the above object an electric connecting device of the present invention includes: a first connector having a first terminal and a first housing supporting the first terminal; a second connector having a second terminal electrically connectable to the first terminal and a second housing supporting the second terminal; and a latch which inhibits separation of the first and second housings from each other. The first housing has a tube-like fitting and the second housing has a fitting receiver for fitting therein the fitting during a connected state in which the first and second connectors are connected to each other. When viewed from a connecting direction in which the first connector connects to the second connector, one of the exterior surface of the fitting and the interior surface of the fitting receiver has plural ribs each projecting in a radial direction of a center portion of the fitting, and another one of the exterior surface of the fitting and the interior surface of the fitting receiver has plural recesses for respectively fitting therein the ribs during the connected state. The ribs, when viewed from the connecting direction, includes two ribs disposed across from each other over the center portion, along a single line extending through the center portion, on the exterior surface of the fitting or the interior surface of the fitting receiver.

In this structure, the first housing has the tube-like fitting and the second housing has the fitting receiver. To connect the first and second connectors to each other, the first housing is inserted into the second housing. The latch serves to inhibit separation of the first and second housings from each other. Further, the plurality of ribs are formed to project from one of the exterior surface of the fitting and the interior surface of the fitting receiver. The plurality of recesses are formed on another one of the exterior surface of the fitting and the interior surface of the fitting receiver. Respectively fitting the ribs in the recesses firmly connects the first and second housings with each other so that rattling does not take place. Each of the ribs projects in a radial direction, and therefore vibrations in two directions perpendicular to each other when viewed from the connecting direction are simultaneously restrained with a single rib. Further, the ribs include two ribs which are disposed across from each other over the center portion of the fitting or fitting receiver, along a single line extending through the center line, when viewed from the connecting direction. With these two ribs disposed to oppose each other, the vibrations in two directions perpendicular to each other are effectively restrained with a minimum number of ribs.

Thus, the connected state of the both connectors is maintained while reducing an effect from vibration, with a simple structure. Therefore, even if the electric connecting device is subject to vibration, disconnection or a damage due to wear and tear is restrained.

Further, with the structure of the present invention, the housing is lightened with the minimum number of the ribs. Therefore, the entire connector is less likely given an adverse effect from vibration. This allows adoption of a latch whose resiliently-holding-force is relatively low.

The electric connecting device of the present invention may be adapted so that: the fitting is formed in the shape of a quadrangular tube; and the plural ribs or the plural recesses formed on the exterior surface of the fitting includes two to four ribs or two to four recesses which are respectively disposed at corner portions of the fitting. This simplifies the shape of the housing and the positions of the ribs or the recesses.

The electric connecting device of the present invention may be adapted so that: the fitting is formed in a cylindrical shape; and the plural ribs or the plural recesses formed on the exterior surface of the fitting includes two to four ribs or two to four recesses which are disposed at an equal interval in a circumferential direction of the fitting when viewed from the connecting direction. This simplifies the shape of the housing and the positions of the ribs or the recesses.

Further, to achieve the foregoing object, a latch-mountable connector housing of the present invention is for one of a pair of connectors connectable to each other, the housing including: a main body connectable to a counterpart connector of a counterpart housing, which supports a connector terminal electrically connectable to a counterpart terminal of the counterpart connector; and a latch which inhibits separation of the main body and the counterpart housing from each other. The main body has a fitting receiver for fitting therein a tube-like fitting formed on the counterpart housing, during a connected state in which the pair of connectors are connected to each other. When viewed from a connecting direction in which the pair of connectors connect to each other, the interior surface of the fitting receiver has (i) plural ribs each projecting in a radial direction of a center portion of the fitting or (ii) plural recesses each formed in the radial direction. The plural ribs or the plural recesses on the interior surface of the fitting receiver includes two ribs or two recesses disposed across from each other over the center portion, along a single line extending through the center line, when viewed from the connecting direction. With this, the connected state of the both connectors is maintained while reducing an effect from vibration, with a simple structure.

The latch-mountable connector housing of the present invention may be adapted so that: the fitting is formed in the shape of a quadrangular tube; and the plural ribs or the plural recesses formed on the interior surface of the fitting receiver includes two to four ribs or two to four recesses which are respectively disposed in positions corresponding to corner portions of the fitting, during the connected state. This simplifies the shape of the housing and the positions of the ribs or the recesses.

The latch-mountable connector housing of the present invention may be adapted so that: the fitting is formed in a cylindrical shape; and the plural ribs or the plural recesses formed on the interior surface of the fitting receiver include two to four ribs or two to four recesses which are disposed at an equal interval in a circumferential direction of the fitting receiver when viewed from the connecting direction. This simplifies the shape of the housing and the positions of the ribs or the recesses.

Further, to achieve the foregoing object, a latch-mountable connector housing of the present invention is for one of a pair of connectors connectable to each other, the housing including: a main body connectable to a counterpart connector of a counterpart housing, which supports a connector terminal electrically connectable to a counterpart terminal of the counterpart connector; and a latch which inhibits separation of the main body and the counterpart housing from each other. The main body is formed as a tube-like fitting to fit in a fitting receiver formed on the counterpart housing, during a connected state in which the pair of connectors are connected to each other. When viewed from a connecting direction in which the pair of connectors connect to each other, the exterior surface of the fitting has (i) plural ribs each projecting in a radial direction of a center portion of the fitting or (ii) plural recesses each formed in the radial direction. The plural ribs or the plural recesses on the exterior surface of the fitting includes two ribs or two recesses disposed across from each other over the center portion, along a single line extending through the center line, when viewed from the connecting direction. With this, the connected state of the both connectors is maintained while reducing an effect from vibration, with a simple structure.

The latch-mountable connector housing of the present invention may be adapted so that: the fitting is formed in the shape of a quadrangular tube; and the plural ribs or the plural recesses includes two to four ribs or two to four recesses which are respectively disposed at corner portions of the fitting. This simplifies the shape of the housing and the positions of the ribs or the recesses.

The latch-mountable connector housing of the present invention may be adapted so that: the fitting is formed in a cylindrical shape; and the plural ribs or the plural recesses formed on the exterior surface of the fitting includes two to four ribs or two to four recesses which are disposed at an equal interval in a circumferential direction of the fitting when viewed from the connecting direction. This simplifies the shape of the housing and the positions of the ribs or the recesses.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Overview

Figure 1:
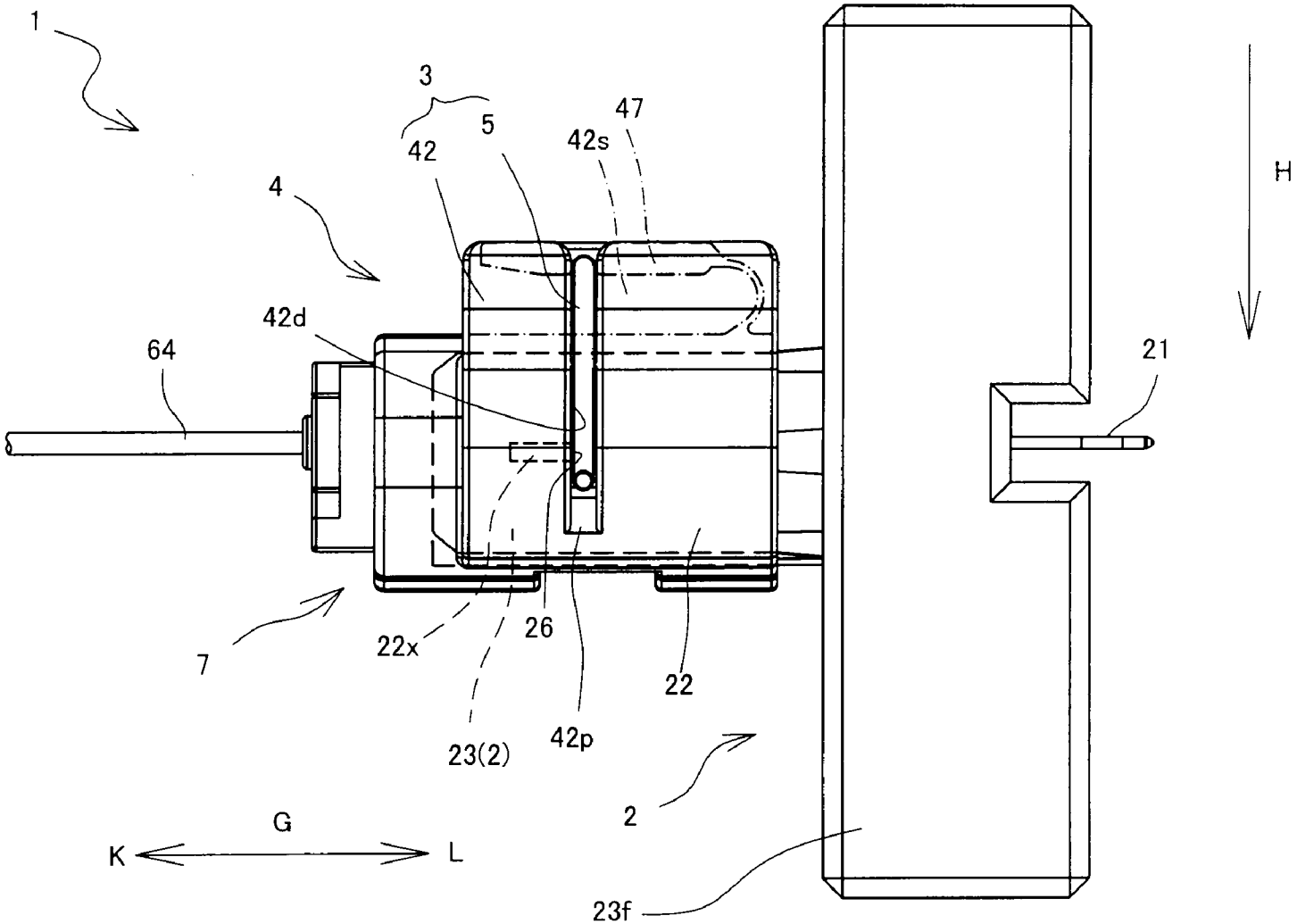
FIG. 1 is a side view illustrating the entire structure of an electric connecting device of Embodiment 1, according to the present invention.

The following describes the entire structure of an electric connecting device of Embodiment 1, according to the present invention. Note that FIG. 2 corresponds to a cross sectional view taken along line A-A' of FIG. 4(*a*).

An electric connecting device 1 is used as an equipment-use connector, which powers an impact acceleration sensor of an airbag system in an auto vehicle. This electric connecting device 1 includes: a first connector 2, a second connector 4, and a metal latch 5. Connecting the second connector 4 to the first connector 2 which is fixed to not-illustrated equipment or the like establishes an electric connection between two first terminals 21 of the first connector 2 and two second terminals 41 of the second connector 4. As a result, the equipment or the like and two wires 64 are electrically connected.

In the electric connecting device 1, the metal latch 5 is attached to a second housing 42 of the second connector 4. This metal latch 5 inhibits separation of the first housing 22 of the first connector 2 from the second housing 42 of the second connector 4. Further, the first and second housings 22 and 42 are made of plastic (insulative material) in the present embodiment.

The electric connecting device 1 of the present embodiment is a bipolar electric connecting device. That is, the electric connecting device 1 has two first terminals 21 and two second connectors 4. Note that the electric connecting device is not limited to the above, and the number of the first terminals (or the number of the second terminals) may be one, or three or more (see Embodiments 2 and 3 below).

Note that in the following description, a direction of connecting the pair of connectors (first and second connectors 2 and 4) to each other is referred to as "connecting direction" (see the direction indicated by Arrow G of FIG. 1 and FIG. 3).

(First Connector)

First, the first connector 2 is described. The first connector (counterpart connector) 2 has two first terminals (counterpart terminals) 21, and a first housing (counterpart housing) 22. These members are detailed below. Note that members within a range indicated by Arrow B of FIG. 3 are members constituting the first connector 2.

(First Housing)

The first housing 22 supports the two first terminals 21 and has a fitting 23 formed in the shape of a tube-like shape and a base 22*f*. The fitting 23 fits in a later-mentioned fitting receiver 43 of the second connector 4, while the first and second connectors 2 and 4 are connected to each other (hereinafter, connected state; see FIG. 1). Further, in the present embodiment, the fitting 23 is formed in a quadrangular tube. More specifically, the fitting 23 is a tube whose cross section perpendicular to the connecting direction G is substantially a quadrangle (see FIGS. 6(*b*) and 11). Further, the base 22*f* is fixed to a piece of equipment or the like. Note that the shape of the fitting is not limited and does not have to be a quadrangular tube, provided that the fitting has a tube-like shape (e.g. see Embodiment 2 below).

Figure 6:
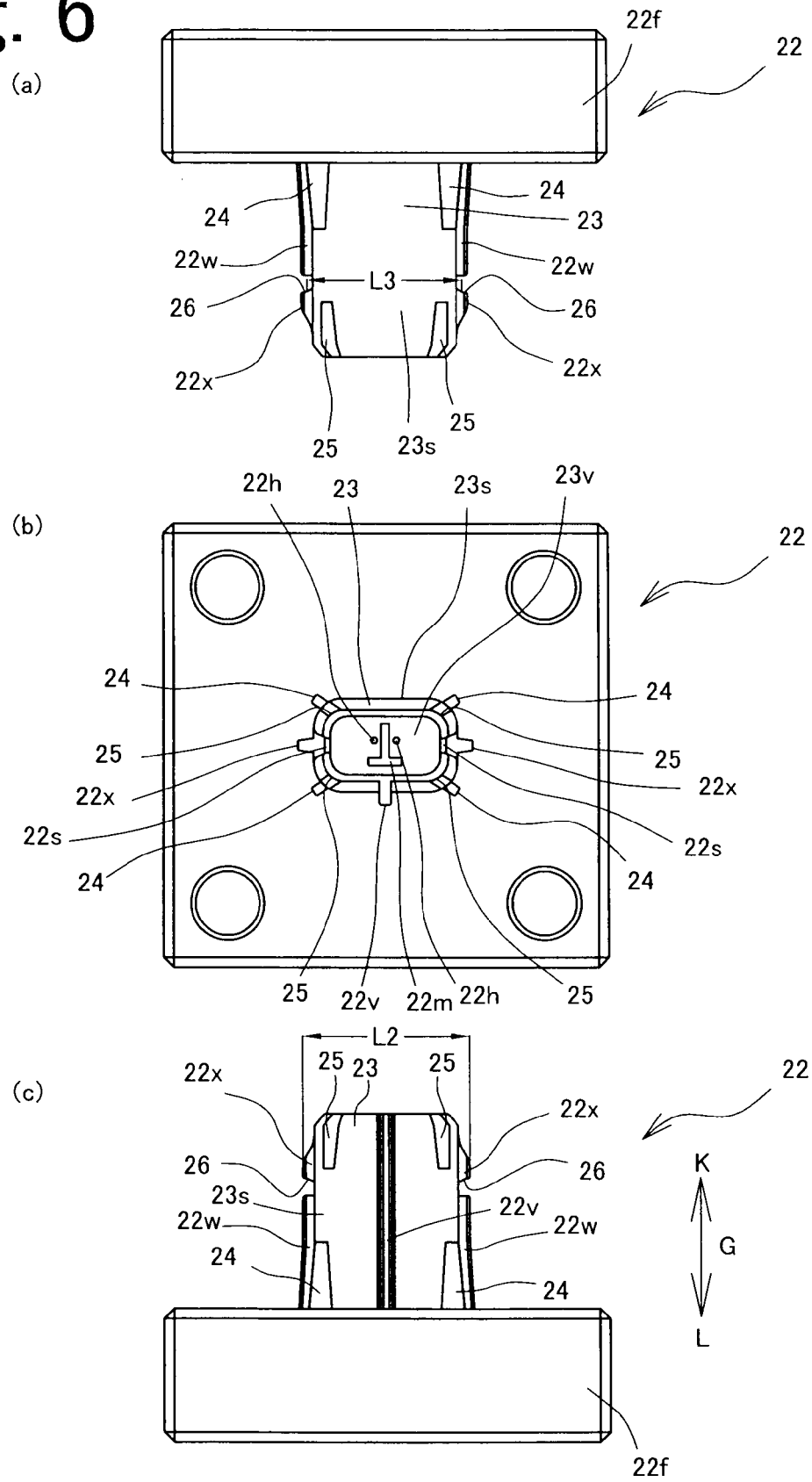
FIG. 6 is a schematic view of a first housing of FIG. 1, where FIG. 6(*a*) is a plane view, FIG. 6(*b*) is a front view, and FIG. 6(*c*) is a bottom view.
Figure 11:
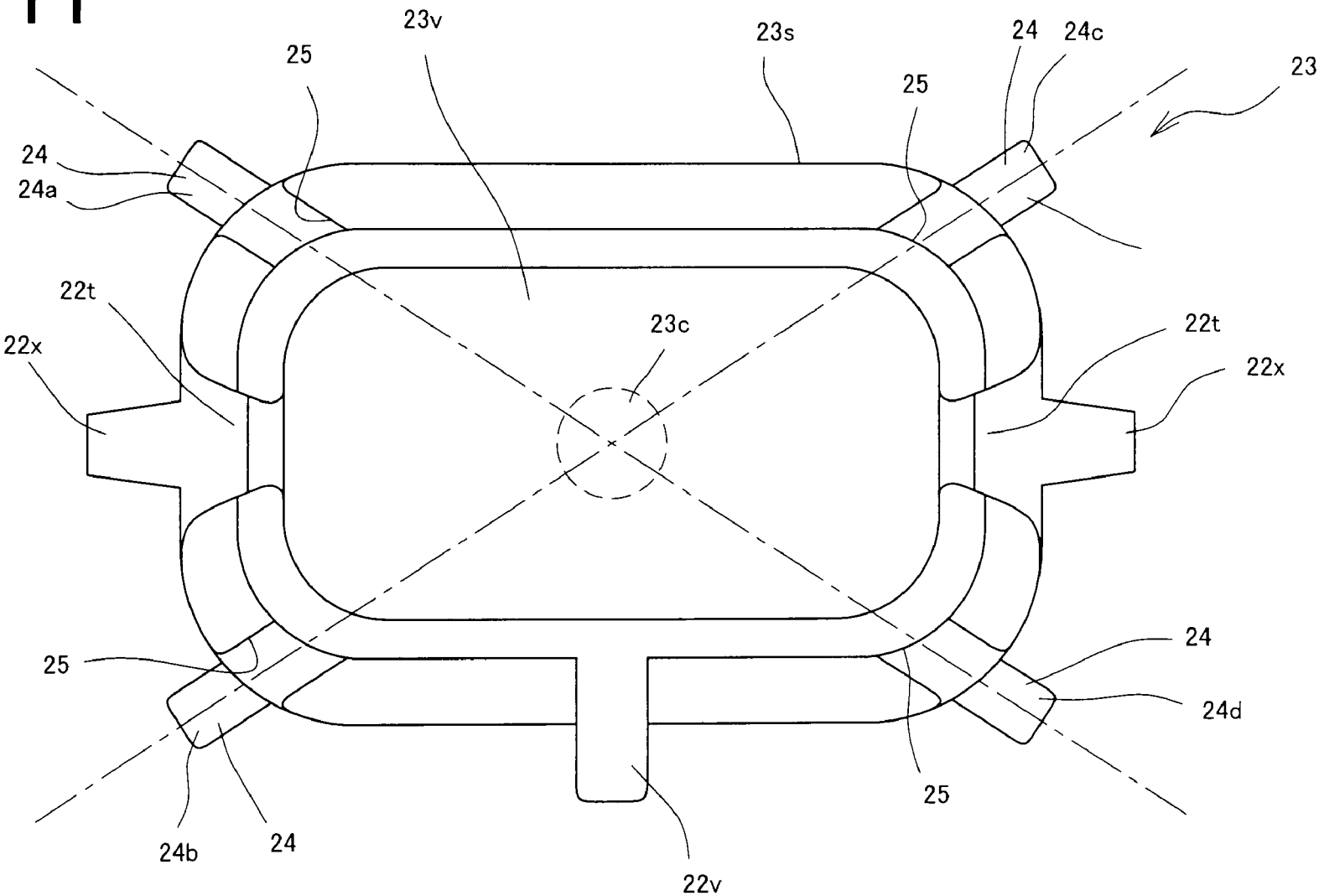
FIG. 11 is an enlarged front view of the first housing of FIG. 1.

The fitting 23 has four ribs 24, the details of which are provided below. When viewed from the connecting direction G, each of the four ribs 24 is formed so as to project from the exterior surface 23*s* of the fitting 23 in a radial direction of a center portion 23*c* of the fitting 23 (see directions of single-dotted lines in FIG. 11), as illustrated in FIGS. 3, 6(*b*), and 11. Further, the four ribs 24 are formed on the root (an end of the fitting 23 closer to the base 22*f*) of the fitting 23, as illustrated in FIGS. 3, 6(*a*), 6(*c*), and 7(*d*). Note that the radial directions indicated by the chain line (the directions in which the ribs project) in FIG. 11 are solely to serve as examples selected from countless number of radial directions, and "radial direction(s)" in this specification is not limited to these directions.

The following further details the ribs 24. The four ribs 24, which are formed on the exterior surface 23*s* of the fitting 23 in the shape of a quadrangular tube, are respectively positioned at four corner portions of the fitting 23 (see FIGS. 3, 6(*b*), and 11). Further, when viewed from the connecting direction, two out of the four ribs 24 on the exterior surface 23*s* of the fitting 23 are positioned across from each other over the center portion 23*c* of the fitting 23, along a single line extending through the center portion 23*c*. In the example presented in FIG. 11, ribs 24*a* and 24*d* (or ribs 24*b* and 24*c*) are those two ribs 24 positioned across from each other over the center portion 23*c*, along a single line extending through the center portion 23*c*.

For example, the two ribs positioned across from each other over the center portion, along a single line extending through the center portion may be respectively disposed at both ends of a diagonal line of the fitting in the front view. That is, the two ribs may be respectively disposed at two positions where a single line connecting the two positions via the center portion is the longest. The arrangement of the ribs 24 in the present embodiment is based on the perspective thus described. Note that the positions of the ribs are not limited to this.

The number of ribs 24 is not limited to four, provided that the ribs 24 includes at least two ribs 24 (ribs 24*a* and 24*d* or ribs 24*b* and 24*c* in the present embodiment) opposing each other (see first and second alternative forms below). Further, two or three ribs may be disposed at corner portions on the exterior surface of the fitting formed in the shape of a quadrangular tube (see first and second alternative forms below).

Further, when viewed from the connecting direction, the exterior surface 23*s* of the fitting 23 is provided with four supplementary recesses 25. These four supplementary recesses 25 are formed so as to dent towards the center portion 23*c* of the fitting 23, in a radial direction of the center portion 23*c* (see FIGS. 3, 6(*b*), and 11). Further, the four supplementary recesses 25 are formed at the leading end of the exterior surface 23*s* of the fitting 23 (see FIGS. 3, 6(*a*), and 7(*d*)).

In the present embodiment, the expression "in a radial direction" means in a radial direction about the center portion 23*c*. The center portion 23*c* is a single point in the present embodiment; however, the center portion 23*c* may be a group of two or more points whose respective positions are different from one another. Further, the center portion may be a region having a certain dimension.

Figure 3:
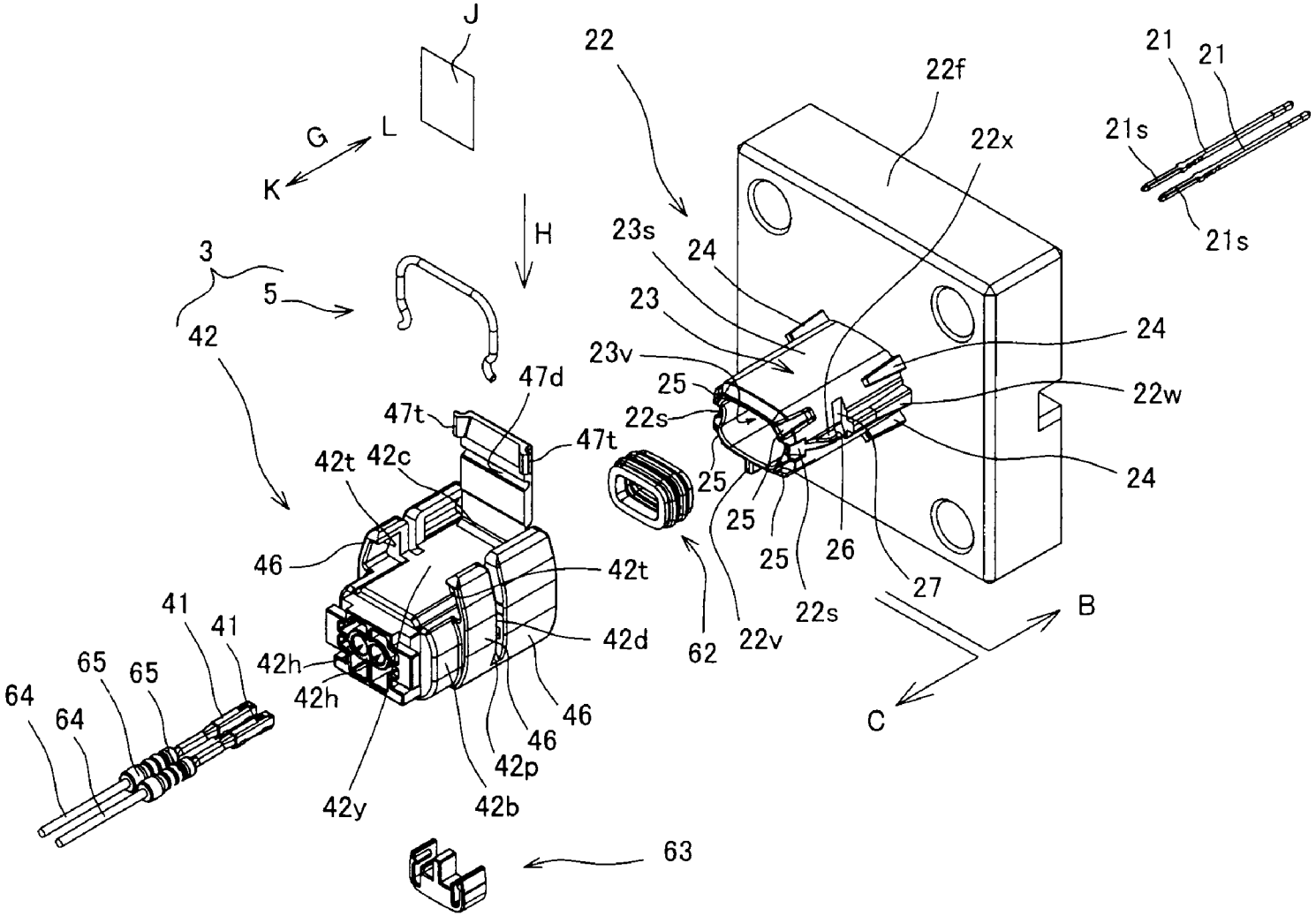
FIG. 3 is an exploded perspective view illustrating parts constituting the electric connecting device of FIG. 1.

Further, where the connecting direction is a direction of connecting the second housing 42 to the first housing 22, an end at the back side of the first housing 22 relative to the connecting direction (K side in FIG. 3; the side of the first housing 22 opposite to the base 22*f*) is provided with a pair of connection sloping surface 22*s* for spreading a pair of support portions 51 (see FIGS. 3, 6(*b*), and 7(*b*)).

Figure 7:
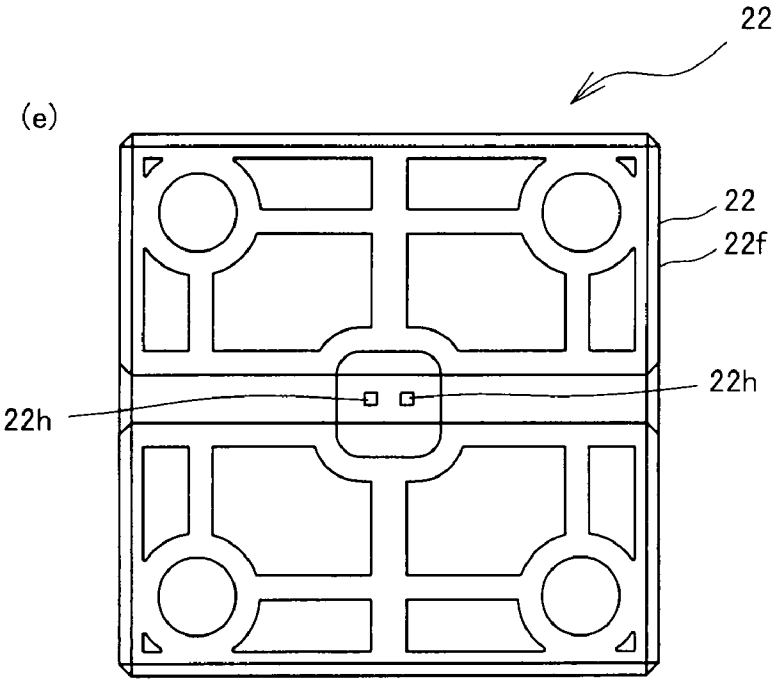
FIG. 7 is a schematic view of the first housing of FIG. 1, FIG. 7(*d*) is a right side view, and FIG. 7(*e*) is a back view.
Figure 7:
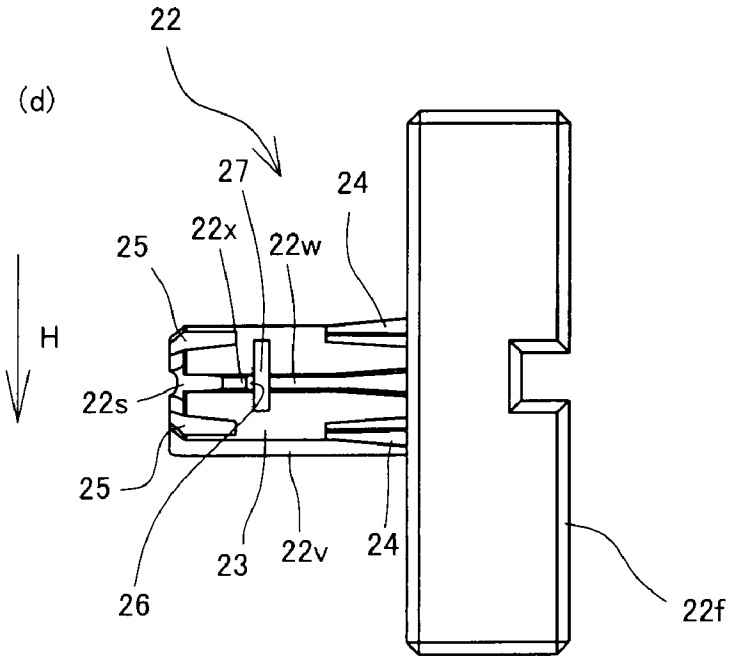

Further, on both side portions of the first housing 22, projections 22*x* are formed respectively (see FIGS. 3, 6, and 7(*d*)). At the front side of each projection 22*x* relative to the connecting direction (L side on FIG. 6(*c*); the side of the projection 22*x* closer to the base 22*f*) is a sloping surface serving as a support receiver 26 (see FIGS. 3, 6(*c*), and 7(*d*)). More specifically, the sloping surface serving as the support receiver 26 is such that the height (projection amount) thereof from the exterior surface 23*s* is gradually reduced from the back side to the front side of the support receiver 26 in the connecting direction G (i.e., towards L side on FIG. 6(*c*)). During the connected state, support portions 51 of the metal latch 5 are respectively latched on and closely attached to the support receivers 26. In the present embodiment, L2 is the distance between the leading ends of the projections 22*x* (see FIG. 6(*c*)), and L3 is the distance between later-mentioned portions of the support receivers 26 where the support portions 51 contact during the connected state (see FIG. 6(*a*)).

In addition to the two projections 22*x* on the both side portions of the fitting 23, the fitting 23 is provided with two guide projections 22*w* (see FIGS. 3, 6, and 7). The guide projections 22*w* on both side portions of the fitting 23 are formed on the exterior surface 23*s*, and linearly extend in the connecting direction. Further, on each side of the fitting 23, the projection 22*x* and guide projection 22*w* are arranged in the connecting direction. The projection 22*x* and the guide projection 22*w* are arranged in a non-continuous manner so as to form a groove between these projections. In the groove is formed a side recess 27 (see FIG. 7(*d*)).

At the bottom of the fitting 23 is formed a guide projection 22*v* for preventing miss-fitting (see FIGS. 3, 6(*b*), and 7(*d*)). The guide projection 22*v* is also formed so as to linearly extend in the connecting direction.

Further, inside the fitting 23 is formed an internal space 23*v* (see FIGS. 3, 6(*b*), and 11). At the front side of the internal space 23*v*, a T-shape fitting recess 22*m* is formed (see FIGS. 2 and 6(*b*)). Further, the first housing 22 has two insertion holes 22*h* in which two first terminals 21 are respectively inserted (see FIGS. 2, 6(*b*), and 7(*e*)). Note that the FIG. 11 omits illustration of the fitting recess 22*m* and the two insertion holes 22*h*.

(First Terminal)

The two first terminals 21 are electrically connectable to the two second terminals 41 during the connected state, respectively. Each of the two first terminals 21 is formed in a rod-like shape (see FIGS. 2 and 3). On the leading end of each first terminal 21 is formed a contact portion 21*s* which contacts the second terminal 41. The connected state of the first and second terminals 21 and 41 is detailed hereinbelow in the description of the second terminals 41.

(Second Connector)

Next described is the second connector 4. The second connector (connector) 4 is electrically connectable to the first connector 2, and has two second terminals (connector terminals) 41, a second housing (connector housing) 42, a seal ring 62, and a retainer 63. Each of these members is detailed below. Note that members within a range indicated by Arrow C of FIG. 3, except for the metal latch 5, are members constituting the second connector 4.

(Second Housing)

The second housing 42 supports the two second terminals 41, and includes: a main body 42*b* connectable to the first housing 22; a cover 47; and a flexible jointing portion 42*c*. The main body 42*b* is used for supporting the two second terminals 41. The main body 42*b* of the second housing has a fitting receiver 43 for fitting therein the fitting 23 during the connected state (see FIGS. 2, and 9(*e*)). More specifically, the main body 42*b* is formed in the shape of a quadrangular tube (see FIG. 9(*e*)), and the fitting receiver 43 is formed inside the quadrangular tube. Here, the fitting receiver 43 has a space formed inside the main body 42*b* and an interior surface 43*s* surrounding the space.

Figure 9:
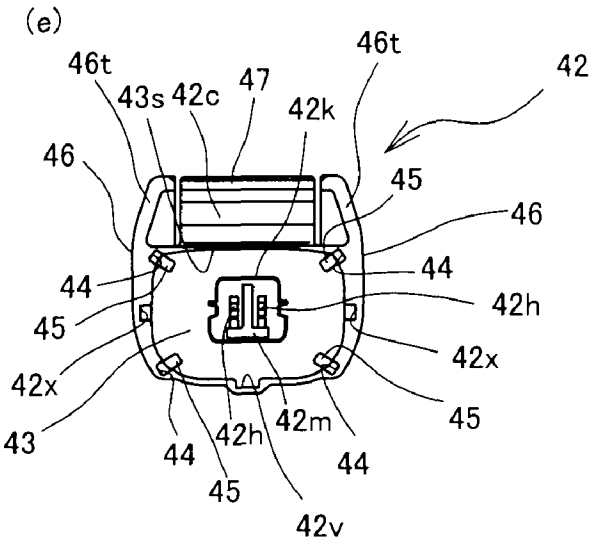
FIG. 9 is a schematic view of the second housing of FIG. 1, FIG. 9(*d*) is a right side view, and FIG. 9(*e*) is a back view.
Figure 9:
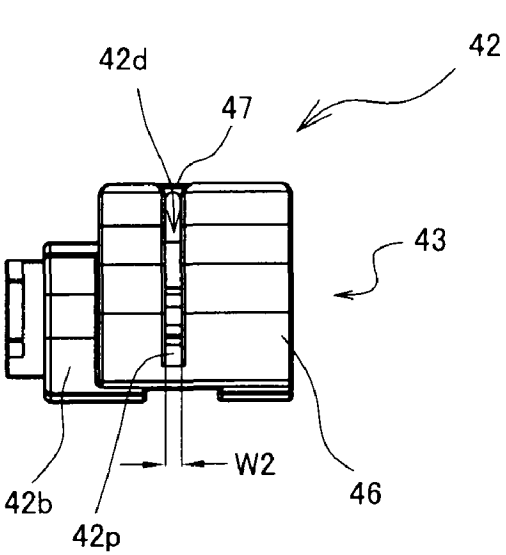

In the interior surface 43*s* are formed four recesses 44 (see FIG. 9(*e*)). During the connected state, the four ribs 24 of the fitting 23 fit in the below-detailed four recesses 44, respectively.

When viewed from the connecting direction, the interior surface 43*s* of the fitting receiver 43 has four recesses 44 each of which is dented in a radial direction of the center portion of the fitting receiver 43 (see FIG. 9(*e*)). Further, the four recesses 44 are formed at the front side (opening side) of the fitting receiver 43.

The recesses 44 are further detailed below. In the main body 42*b* formed in the shape of quadrangular tube, the four recesses 44 are disposed in positions corresponding to the corner portions of the fitting 23 during the connected state (see FIG. 9(*e*)). Further, when viewed from the connecting direction, two out of the four recesses 44 on the interior surface 43*s* are positioned across from each other over the center portion of the fitting receiver 43, along a single line extending through the center portion.

The interior surface of the fitting receiver formed in the shape of a quadrangular tube may have at its corner portions two or three recesses 44, and the number of the recesses is not limited to four.

Further, when viewed from the connecting direction, the interior surface 43*s* of the fitting receiver 43 has four supplementary ribs 45 each projecting in a radial direction of the center portion of the fitting receiver 43 (see FIG. 9(*e*)). Further, the four supplementary ribs 45 are formed at the back side of the interior surface 43*s* of the fitting receiver 43. These four supplementary ribs 45 fit in the four supplementary recesses 25 formed on the fitting 23, during the connected state.

Further, inside the second housing 42 are formed two guide grooves 42*x* which linearly extend in the connecting direction (see FIG. 9(*e*)). The two guide grooves 42*x* are grooves for fitting therein two projections 22*x* and two guide projections 22*w* of the first housing 22 during the connecting operation. Further, inside the second housing 42 is formed a guide groove 42*v* which linearly extends in the connecting direction (see FIG. 9(*e*)).

The guide groove 42*v* is a groove in which the guide projection 22*v* of the first housing 22 fit in during the connecting operation.

To smoothen the connection of the first and second connectors 2 and 4, the width of the guide groove 42*v* is relatively wider than that of the guide projection 22*v*. That is, the guide projection 22*v* and the guide groove 42*v* have therebetween a play. The same goes to the guide grooves 42*x*, and the width of each guide groove 42*x* is relatively wider than each projection 22*x* or each guide projection 22*w*.

Figure 4:
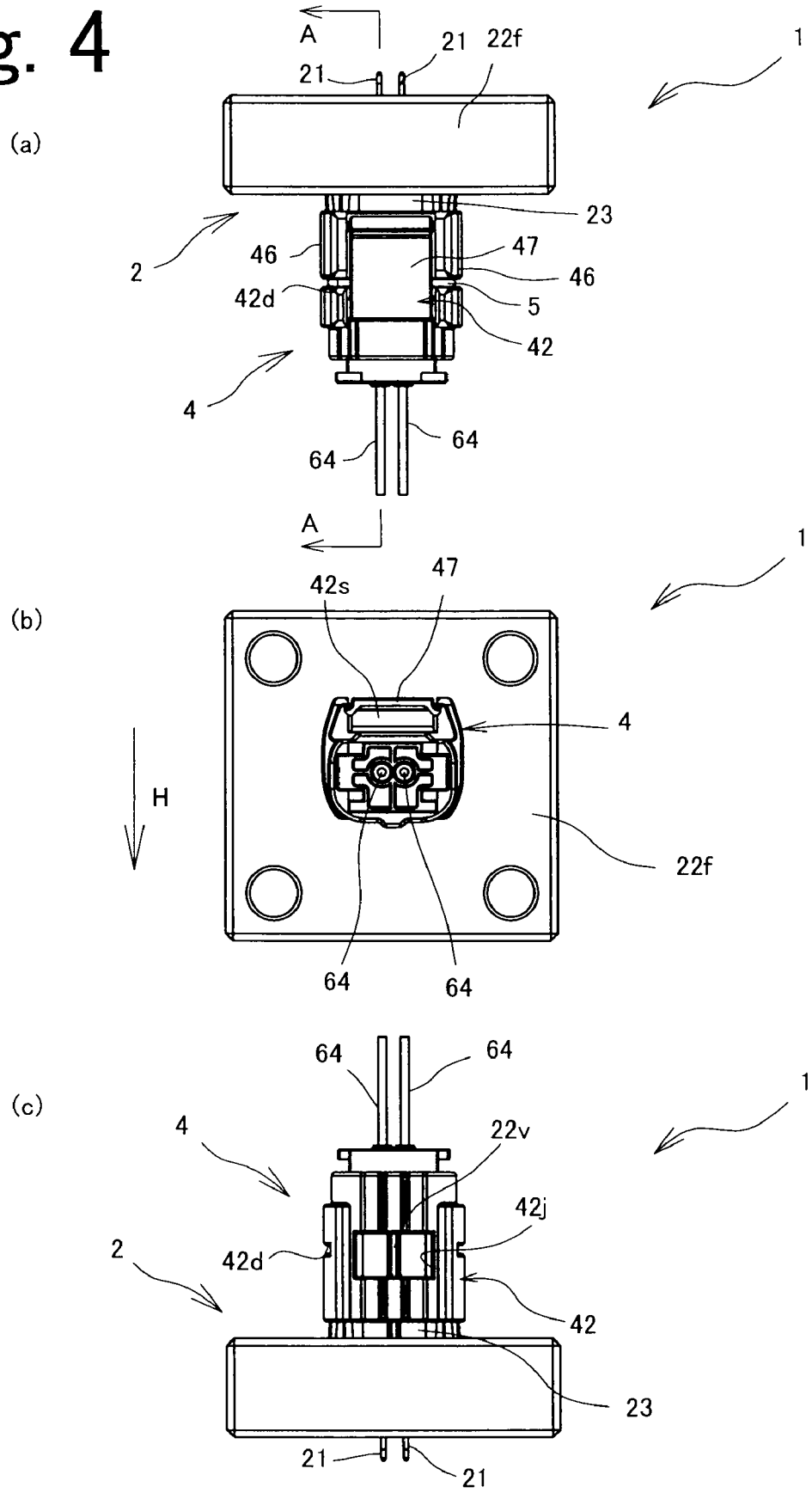
FIG. 4 is a schematic view of the electric connecting device of FIG. 1, where FIG. 4 (*a*) is a plane view, FIG. 4 (*b*) is a front view, and FIG. 4 (*c*) is a bottom view.

The second housing 42 has two grooves 42*d*. To these grooves 42*d* is attached the metal latch 5. Specifically, two side walls 46 are formed on both side portions of the main body 42*b*. The grooves 42*d* are formed on the two side walls 46, respectively. Here, the depth of each groove 42*d* on either one of the two side walls 46 is greater than the thickness of the metal latch 5 (see W1 of FIG. 10(*c*)). Therefore, in the electric connecting device 1, the outermost portion of the metal latch 5 is in a position deeper than the surface of the side wall 46, as illustrated in FIG. 4 (*a*). This keeps the metal latch 5 from being touched by a finger. Note that the two side walls 46 are part of the main body 42*b*, in the present embodiment.

Figure 5:
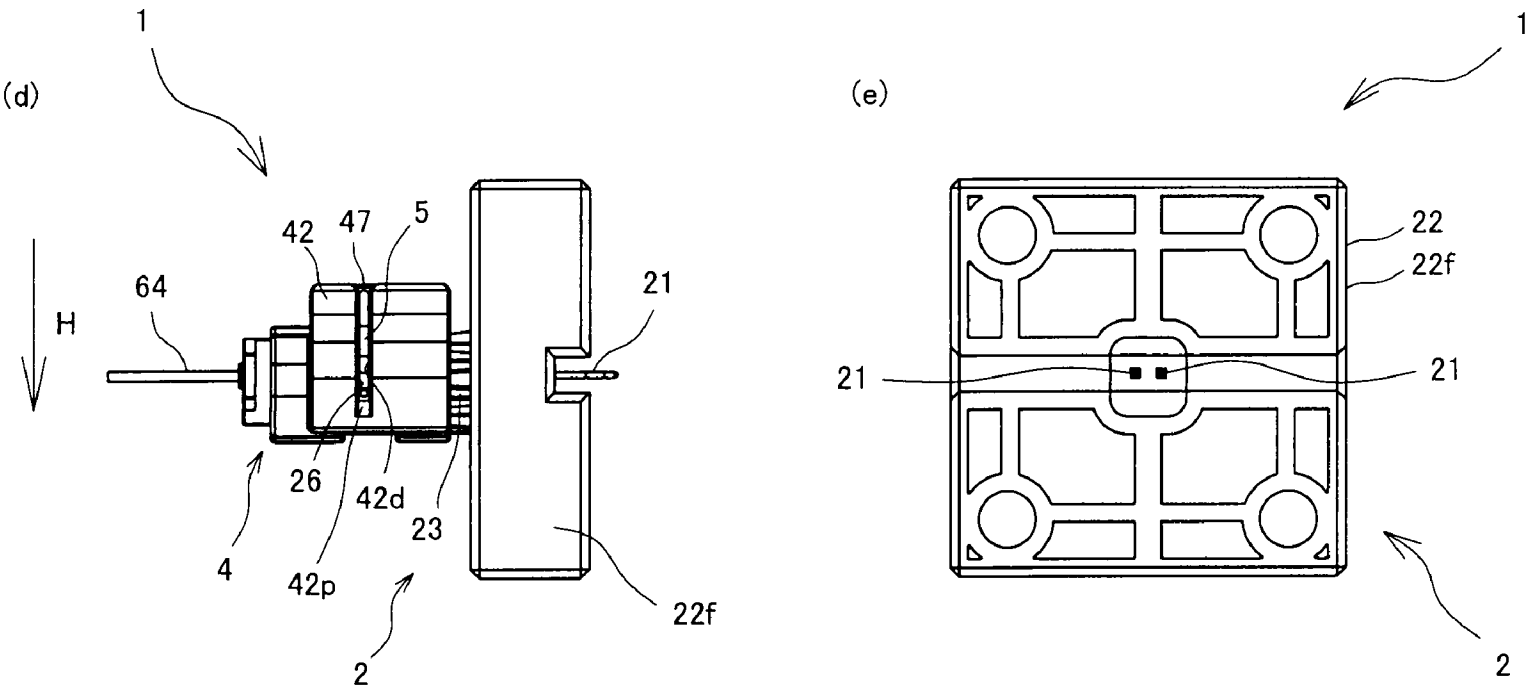
FIG. 5 is a schematic view of the electric connecting device of FIG. 1, where FIG. 5 (*d*) is a right side view, and FIG. 5 (*e*) is a back view.

In the main body 42*b* of the second housing 42, each groove 42*d* has an unlocking sloping surface 42*p* (see FIGS. 1, 3, 5(*b*), and 9(*d*)). The unlocking sloping surface 42*p* is formed at the front side (lower side in FIG. 1) of the groove 42*b* relative to a direction of mounting the metal latch 5 (i.e., in the direction of Arrow H in FIGS. 1, 3, or the like; hereinafter, mounting direction).

Figure 8:
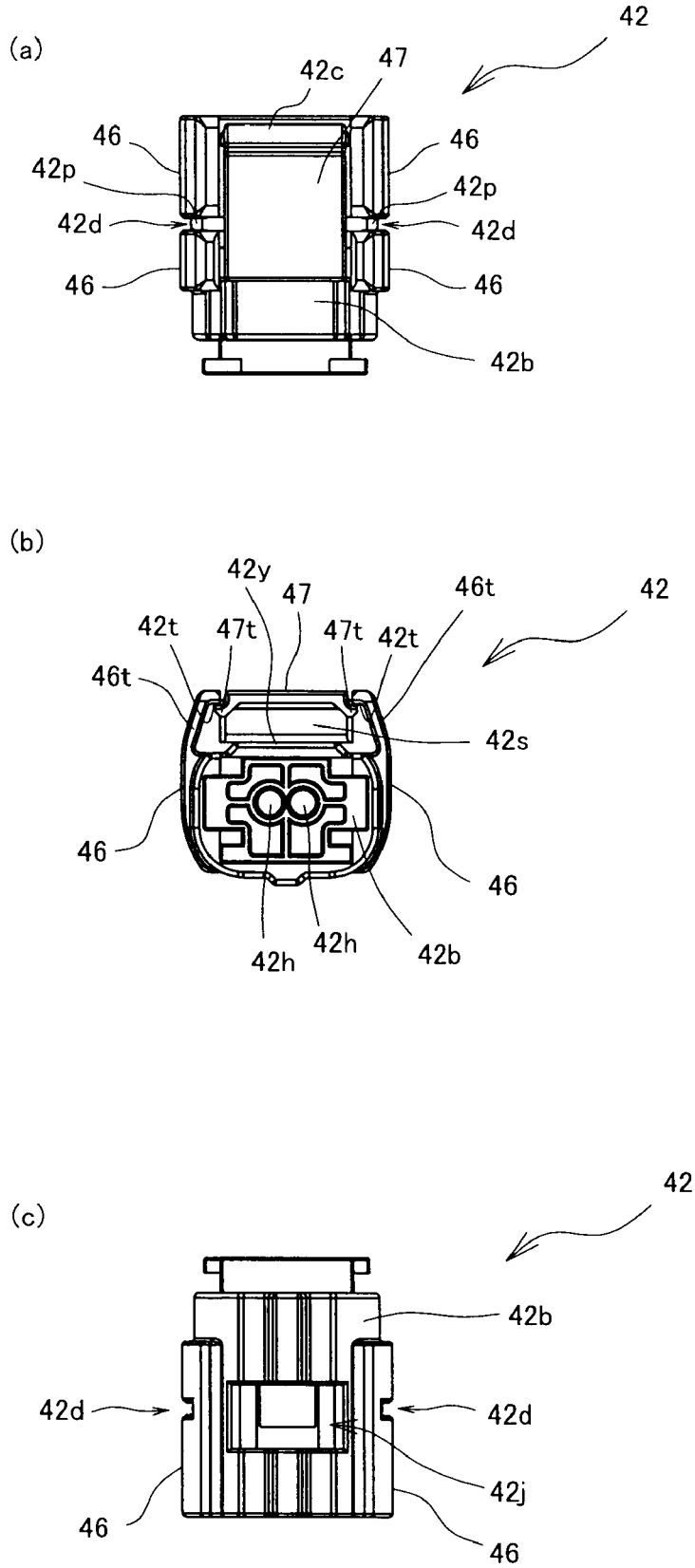
FIG. 8 is a schematic view of a second housing of FIG. 1, where FIG. 8(*a*) is a plane view, FIG. 8(*b*) is a front view, and FIG. 8(*c*) is a bottom view.

Further, in the present embodiment, each of the two side walls 46 has a projecting leading part 46*t* which projects in the opposite direction to the mounting direction (upward in FIG. 8(*b*)), beyond the top surface of the middle portion 42*y* of the main body 42*b* (see FIG. 8(*b*)). Note that the shape of each sidewall is not limited to this, and the projecting leading part 46*t* does not necessarily have to be formed. Further, each of the grooves may be formed in a position other than the side wall.

Figure 2:
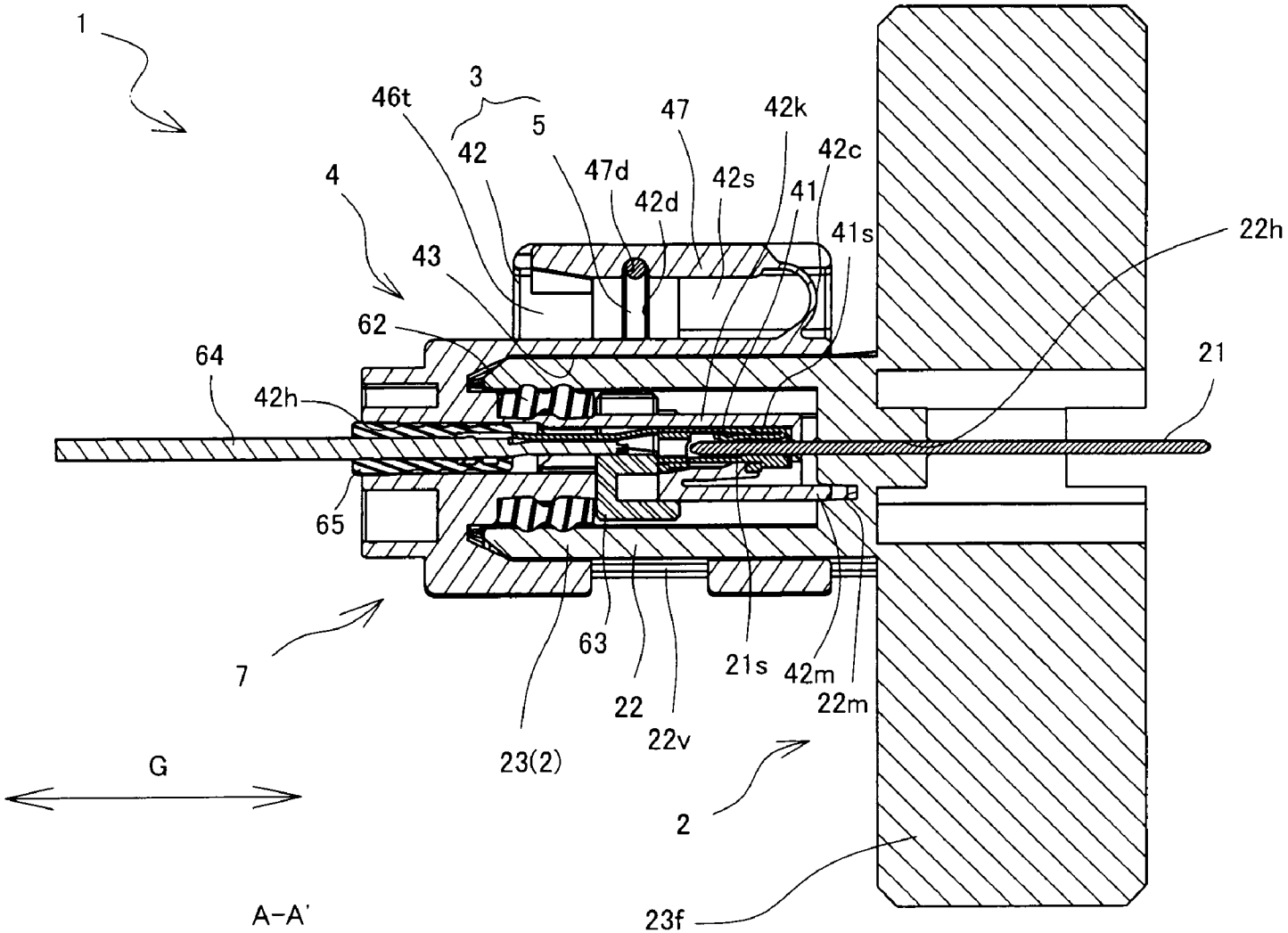
FIG. 2 is a cross sectional view of the electric connecting device of FIG. 1.

The second housing 42 has a cover 47 for covering the metal latch 5. The cover 47 is formed in a plate like shape, and the cover 47 and the main body 42*b* are formed in one piece via the flexible jointing portion 42*c* (FIGS. 1, 2, 3, or the like). Further, the cover 47 is formed in one piece with the main body 42*b* so that only one end of the cover 47 is fixed.

The cover 47, the main body 42*b*, and the projecting leading part 46*t* form a space 42*s* for the metal latch 5, which accommodates therein a middle support portion 53 of the metal latch 5 (see FIGS. 2 and 4(*b*), and 8(*b*)). Further, the cover 47 has a cover groove 47*d* on a surface thereof facing the main body 42*b* (see FIGS. 2 and 3). While the cover 47 is closed as shown in FIGS. 1, 2, 4, and 5, the middle support portion 53 is accommodated in the cover groove 47*d* (see FIG. 2). the cover 47 is inclined from the main body 42*b* as illustrated in FIG. 3, at the time of assembling the second connector 4. Bending the cover 47 at the flexible jointing portion 42*c*, while the metal latch 5 is mounted to the second housing 42, covers the metal latch 5 (covering state).

During the covering state, the metal latch 5 fits in the cover groove 47*d*. Therefore, an increase in the size of the second connector 4 in the longitudinal direction of FIGS. 1 and 2 is prevented, and downsizing of the connector in the longitudinal direction is possible. Further, fitting the metal latch 5 in the cover groove 47*d* stabilizes the positional relationship of the cover 47 to the metal latch 5. Therefore, the metal latch 5 is reliably pressed in with a use of the cover 47, in a later-mentioned unlocking operation. Note that the cover groove 47*d* does not necessarily have to be formed.

Further, the cover 47 is disposed at the middle portion 42*y* (see FIG. 3) sandwiched between the pair of the side walls 46 of the main body 42*b*. That is the cover 47 is disposed in a position of the main body 42*b*, where no groove 42*d* is formed. Note that the present embodiment deals with a case where no groove 42*d* is formed in the middle portion 42*y* of the main body 42*b*. However, a groove may be formed in the middle portion.

Further, on the both side portions at the leading end of the cover 47, two cover projections 47*t* are formed (see FIG. 3). On the other hand, a projection receiver 42*t* is formed at the back side (K side on FIG. 3) of each side wall 46 relative to the connecting direction G (see FIG. 3). During the covering state, the two cover projections 47*t* are respectively latched on the two projection receiver 42*t* (see FIG. 8 (*b*)). Thus, the cover 47 is inhibited from returning to the inclined state, and the covering state is maintained.

Further, in the main body 42*b* is formed a terminal supporter 42*k* (see FIGS. 2 and 9(*e*)). The terminal supporter 42*k* supports two second terminals 41, along with a later-mentioned retainer 63. During the connected state, the terminal supporter 42*k* and the two second terminals 41 are inserted into the internal space 23*v* of the first housing 22. At the leading end of the terminal supporter 42*k* is formed a T-shaped fitting projection 42*m* (see FIGS. 2 and 9(*e*)). During the connected state, the fitting projection 42*m* is inserted into the fitting recess 22*m* of the first housing 22 (see FIG. 2).

Further, at the back side of the second housing 42 in the connecting direction are formed two insertion holes 42*h* into which the two second terminals 41 are respectively inserted (FIG. 2, 8(*b*), and 9(*a*)). At the bottom part of the second housing 42 is formed an insertion hole 42*j* (see FIG. 8(*c*)). Through the insertion hole 42*j*, the later-mentioned retainer 63 is mounted at the time of assembling the second connector 4.

(Second Terminal)

The two second terminals 41 are electrically connectable to the two first terminals 21, respectively. Each second terminal 41 is formed in the shape of a quadrangular tube (see FIGS. 2 and 3). More specifically, as illustrated in FIG. 2, each of the second terminals 41 has therein a plate contact portion 41*s* which contacts the contact portion 21*s* of the first terminal 21. The contact portion 41*s* is formed in one piece with the outer wall of the quadrangular tube shape of each second terminal 41. When the second terminal 41 and the first terminal 21 are connected to each other, the contact portion 41*s* is resiliently bent at its root portion, contacting the contact portion 21*s* in such a manner as to hold down the contact portion 21*s*. Further, each second terminal 41 is connected to an electric wire 64.

Further, in the present embodiment, a seal cover 65 is attached to each electric wire 64 (FIG. 2 and FIG. 3). The seal cover 65 is inserted into the insertion hole 42*h* of the second housing 42, thereby ensuring the air tightness and water tightness of the second connector 4.

(Metal Latch)

Next, the metal latch 5 is described. The metal latch 5 is a metal member for inhibiting separation of the first and second housings 22 and 42 from each other. Such a metal latch 5 is formed by curving a single rod-like member. More specifically, the metal latch 5 is mounted to the main body 42*b* of the second housing 42, and resiliently sandwiches the first housing 22 and supports the same so as to inhibit the separation of the main body 42*b* from the first housing 22.

Figure 10:
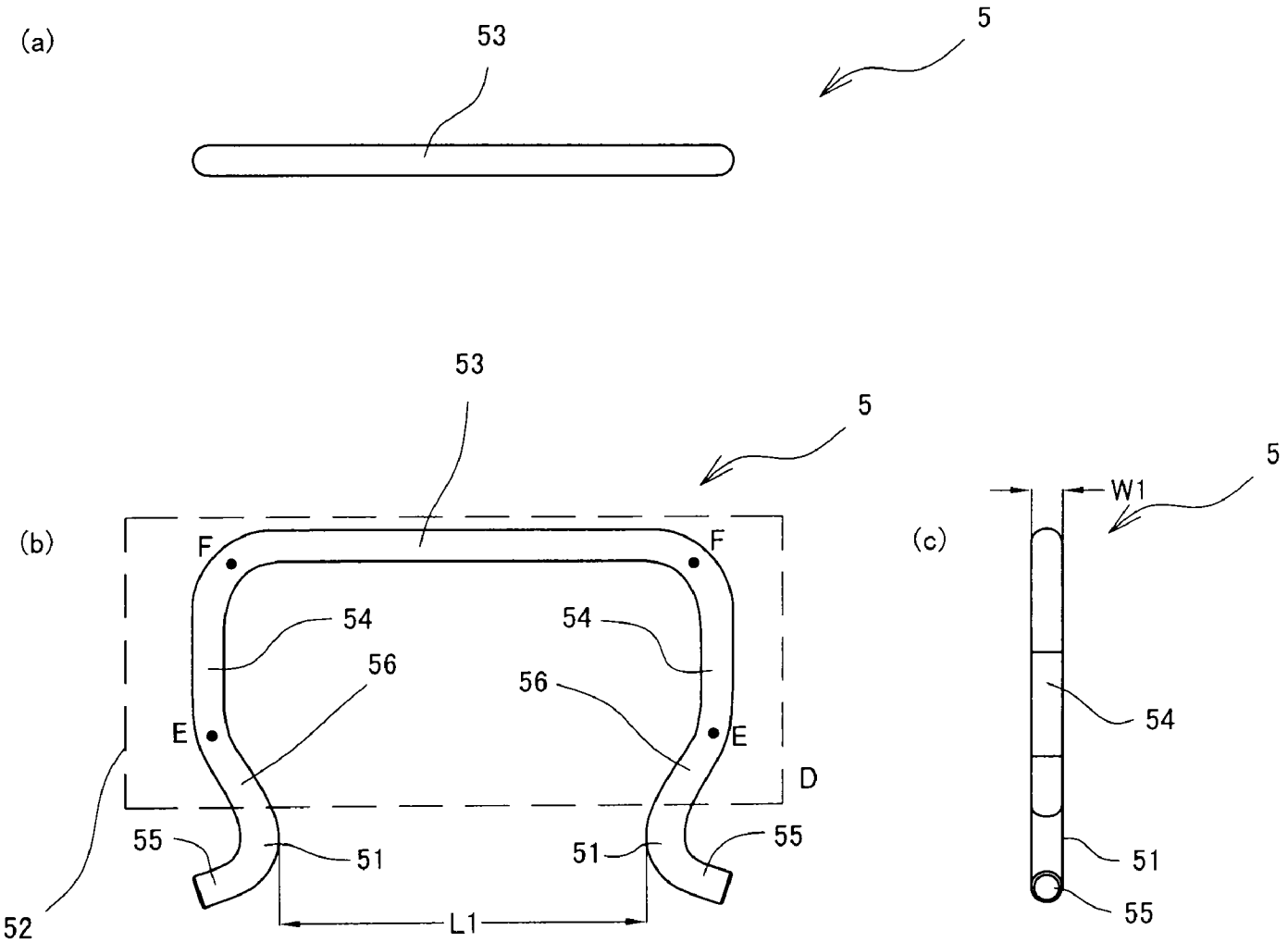
FIG. 10 is a schematic view of a metal latch of FIG. 1, where FIG. 10(*a*) is a plane view, FIG. 10(*b*) is a front view, and FIG. 10(*c*) is a right side view.

The metal latch 5 is formed so as to include: the linearly extending middle support portion 53; a pair of hanging portions 54 which respectively extend from the both ends of the middle support portion 53 perpendicularly to the middle support portion 53; a pair of sloping portions 56 respectively extending inwardly from the pair of hanging portions 54; the pair of support portions 51 which are curved portions respectively formed at the ends of the sloping portions 56; a pair of tip portions 55 formed so as to outwardly extend from the ends of the sloping portions 51 (see FIG. 10(*b*)). In the present embodiment, L1 is a distance between the pair of support portions 51 when the metal latch 5 is not mounted from the second connector 4; i.e., while the metal latch 5 is free of load (see FIG. 10(*b*)). L3 (see FIG. 6(*a*)) is greater than L1, and L2 is greater than L3.

That is, L1, L2, and L3 satisfies the following relation:

$$L1<L3<L2 \quad (1)$$

This relation of L2 being greater than L1 and L3 being smaller than L2 realizes a clicking feel when the metal latch 5 resiliently recovers its original state in a connecting operation. Further, since L1 is greater than L3, the force to restore the original state of the metal latch 5 causes the pair of support portions 51 to sandwich and support the support receiver 26, during the connected state. Note that the above relation among L1, L2, and L3 is solely to serve as an example, and the relation among L1, L2, and L3 is not limited to this.

While the second connector 4 is connected to the first connector 2 (during the connected state), the metal latch 5 sandwiches the first housing 22 between the pair of the support portions 51. Thus, the support portions 51 are respectively latched on the support receiver 26 formed on the first housing 22. In other words, the projections 22*x*, during the connected state, inhibits the metal latch 5 from moving to separate in the opposite direction to the connecting direction.

The latch main portion 52 of the metal latch 5 surrounded by the broken line in FIG. 10(*b*) has a C-shape whose curvature continuously varies in a single plane (i.e. two-dimensionally curved) (see FIGS. 10(*b*), 10(*a*), and 10(*c*)). The latch main portion 52 includes the middle portion between the pair of the support portions 51. Specifically, the latch main portion 52 includes the middle support portion 53, the pair of hanging portions 54, and the pair of sloping portions 56. Note that the latch main portion of the metal latch may have a U-shape whose curvature continuously varies in a single plane.

Further, the latch main portion 52 of the metal latch 5 has a C-shape whose curvature continuously varies in a single plane, and varying the diameter of the metal latch 5 allows setting of an intended resiliently-holding-force.

Further, the metal latch 5 is mounted in a direction perpendicular to the connecting direction along a plane (plane J in FIG. 3) perpendicular to the connecting direction. In short, the mounting direction H is parallel to the plane J.

Further, in the electric connecting device 1, the diameter of the metal latch 5 (W1 of FIG. 10(*c*)) is not more than the width of the groove 42*d* (W2 of FIG. 9(*d*)). That is, the metal latch 5 and the second connector 4 are formed to satisfy the relation of: $W1 \leqq W2$.

For example, the maximum tolerable gravitational acceleration (the maximum gravitational acceleration which ensures that the connected state of the connectors is maintained) and W1 of the metal latch is as follows:

W1: 1.0 [mm] Maximum tolerable gravitational acceleration: 300 [G]

W1: 1.2 [mm] Maximum tolerable gravitational acceleration: 1000 [G]

Thus, the maximum gravitational acceleration tolerated by the metal latch is adjusted by varying W1 without modification of the entire shape. For example, suppose W1 of the metal latch is originally 1.0 mm. In this case, setting the width W2 of the groove to 1.2 mm allows mounting of a different metal latch which tolerates the maximum gravitational acceleration of 1000 G despite variation in the connector installing environment or the like.

In the present embodiment, the metal latch 5 has a pair of support portions 51. However, the metal latch may have two or more pairs of support portions. Further, the metal latch is not particularly limited to the one described in the present embodiment, provided that the metal latch is capable of inhibiting separation of the first and second housings 22 and 42. For example, the latch main portion of the metal latch does not have to have a shape whose curvature continuously varies in a single plane, and may have a three-dimensional structure. Further, the shape of the latch main portion is not limited to a C-shape or a U-shape. For example, the shape of the latch main portion may be a V-shape, an H-shape, or the like. Further, the metal latch may be, for example, a member which locks the housing by latching from inside the housing (see Embodiment 4 below).

(Others)

The second connector 4 has a seal ring 62 and a retainer 63 in addition to the above mentioned members (see FIG. 3). The seal ring 62 is a member which ensures the air tightness and water tightness, whereas the retainer 63 is a member which supports the two second terminals 41.

(Metal-Latch-Mountable Connector Housing)

Next, a metal-latch-mountable connector housing 3 is described. The metal-latch-mountable connector housing 3 includes the main body 42*b* of the second housing 42, and a metal latch 5 (see FIGS. 1, 2, and 3). In the present embodiment, the metal-latch-mountable connector housing 3 is a combination of the second housing 42 and a metal latch 5. Note that the metal-latch-mountable connector housing 3 is not particularly limited, provided that the metal-latch-mountable connector housing 3 is used as one of a pair of connectors connectable to each other. For example, the metal-latch-mountable connector housing 3 may be a combination of the metal latch and the first housing of the present embodiment (see Embodiment 4 below).

(Metal-Latch-Mountable Connector)

Next, a metal-latch-mountable connector 7 is described below. The metal-latch-mountable connector 7 includes: two second terminals 41, the second housing 42, and the metal latch 5 (see FIGS. 1 and 2). That is, the metal-latch-mountable connector 7 includes a metal-latch-mountable connector housing 3 and two second terminals 41.

(Connecting Operation)

Next, the connecting operation of the electric connecting device 1 is described. At the beginning, the metal latch 5 is mounted to the second connector 4, and the cover 47 is in the covering state. Then, at the time of connecting the electric connecting device 1, the second connector 4 with the metal latch 5 being attached thereto is connected to the first connector 2. Note that, at the time of connecting the electric connecting device 1, the connecting operation is performed by holding the two side walls 46 of the second connector 4. The second housing 42 has the cover 47, and therefore, the clicking feel at the time of connecting is not lost even if a finger touches the cover 47 during the connecting operation.

First, the following describes the state at the beginning of connecting the first and second connectors 2 and 4. At the beginning, the tip portions of the metal latch 5 respectively contact the pair of connection sloping surfaces 22*s*, with the movement of connecting the electric connecting device 1 (advancing of the second connector 4). Further advancing the second connector 4 causes the pair of support portions 51 to respectively contact the pair of connection sloping surfaces 22*s*, thereby widening the gap between the pair of the support portions 51. As a result, the second connector 4 smoothly moves towards the first connector 2 without stopping.

Further, at the connection starting time, the second connector 4 is connected to the first connector 2 in such a manner that the guide projection 22*v* fits in the guide groove 42*v*. Thus, miss-fitting (fitting two connectors upside down) is prevented.

Next, the state during the connecting operation is described. During the connecting operation, the guide projection 22*v* of the first housing 22 fit in the guide groove 42*v* of the second housing 42. Further, the two projections 22*x* of the first housing 22 and the two guide projections 22*w* respectively fit in the two guide grooves 42*x* of the second housing 42. Thus, during the connecting operation, the second connector 4 is pressed towards the first connector 2 along these guide grooves; i.e., in the connecting direction.

Further, with the movement of the electric connecting device 1, the support portions 51 advances while contacting the connection sloping surfaces 22*s* and the projections 22*x*. This resiliently deforms the metal latch 5, and increases the distance between the pair of the support portions 51. Here, while the pair of support portions 51 are at the leading end of the projections 22*x*, the distance between the pair of support portions 51 is the maximum (L2). Further pressing the second connector 4 from this state moves the pair of support portions 51 towards the pair of support receivers 26 which are sloping surfaces. At this time, the metal latch 5 having resiliently deformed tries to restore its original shape. Therefore, the pair of support portions 51 move beyond the pair of projections 22*x*, and move toward the center portion 23*c* along the pair of support receivers 26 (sloping surfaces).

More specifically, (A) the distance (Ls) between the pair of supporting portions 51 immediately before the connection completed state is greater than L1 (see FIG. 10(*b*)), and (B) a distance (Le) between the pair of support portions 51 during the connection completed state the connection is completed is smaller than Ls. That is, the following relation is established.

$$L1<Ls \quad (2)$$

$$Le<Ls \quad (3)$$

Thus, the metal latch 5 once having been deformed resiliently restores its original state, yielding the clicking feel upon completion of the connection. In particularly, the following relation is established in the present embodiment.

$$Ls=L2 \quad (4)$$

$$Le=L3 \quad (5)$$

As hereinabove mentioned, after the metal latch 5 is deformed in the connection operation of the electric connecting device 1, a clicking feel is given when the metal latch 5 once having been deformed resiliently restores its original state. That is, when the support portions 51 go over the projections 22*x* formed in the shape of a mountain, a movement of the metal latch 5 to resiliently restore its original state is enabled. This yields the clicking feel which allows an operator to confirm that the pair of connectors are properly connected.

Next, the following describes the connected state in which the first and second connectors 2 and 4 are connected to each other. During this state, the fitting 23 is fit in the fitting receiver 43, and the terminal supporters 42*k* and the two second terminals 41 are inserted into the internal space 23*v* of the fitting 23. The pair of the connectors are connected to each other, and the first and second terminals 21 and 41 are electrically connected.

Further, during the connected state, the fitting projection 42*m* is inserted into the fitting recess 22*m* of the first housing 22. Then, the four ribs 24 of the fitting 23 fit in the four recesses 44, and the four supplementary ribs 45 fit in the four supplementary recesses 25 formed on the fitting 23.

Further, during the connected state, the support portions 51 of the metal latch 5 sandwich therebetween the first housing 22, and the support portions 51 are latched on the support receivers 26 formed on the first housing 22. Then, the metal latch 5 resiliently sandwiching and supporting the first housing 22 inhibits separation of the pair of connectors. This state is referred to as locked state.

During the connected state, the support portions 51 of the metal latch 5 are closely attached to and latched on the sloping surfaces of the support receivers 26. Further, the pair of support portions 51 are latched on the support receivers 26, between the exterior surface 23*s* and the vertex of the projections 22*x*. Then, the metal latch 5 is latched at the front side of the projections 22*x* relative to the connecting direction.

Thus, the metal latch 5 is prevented from separating towards the back side of the first housing 22 relative to the connecting direction.

As described, while the metal latch 5 is mounted to the second connector 4, and while the first and second connectors 2 and 4 are in the connected state, the metal latch 5 is at a mounting position (a position in which the pair of support portions 51 are latched on the pair of support receivers 26). The state in which the metal latch 5 is at the mounting position during the connected state is hereinafter referred to as "connection completed state" (see FIGS. 1, 2, 4, and 5).

Next, the following describes a separating operation of the first and second connectors 2 and 4. For the separating operation, the locked state of the metal latch 5 needs to be released. In the electric connecting device 1, pressing the cover 47 with a finger or the like towards the main body 42*b* while the metal latch 5 is in the mounting position further presses the metal latch 5 in the mounting direction. Then, the unlocking sloping surfaces 42*p* and the pair of the support portions 51 respectively contact each other, thus widening the gap between the pair of support portions 51 (unlocked state). The electric connecting device 1 easily allows this unlocking operation (operation of unlocking the metal latch 5).

The present embodiment deals with a case where each support receiver 26 is formed as a sloping surface of the projection 22*x*. However, the support receiver is not limited to the present embodiment. The support receiver may be formed perpendicularly to the surface of the exterior surface 23*s*, instead of forming the same as a sloping surface. Further, instead of realizing the support receiver with the front side of the projection, the housing main body may be provided with a groove serving as a support receiver. The clicking feel upon completion of connection is achieved in either cases, by structuring the support receiver to satisfy the above formulas (2) and (3).

(Effects)

Next, the following describes effects achieved by the electric connecting device 1 and the metal-latch-mountable connector housing 3 of the present embodiment. The electric connecting device 1 of the present embodiment includes: the first connector 2 having two first terminals 21 and the first housing 22 supporting the first terminals 21; the second connector 4 including two second terminals 41 electrically connectable to the two first terminals 21, respectively, and the second housing 42 supporting the two second terminals 41; and the metal latch 5 which inhibits separation of the first and second housings 22 and 42 from each other. The first housing 22 has the tube-like fitting 23, and the second housing 42 has the fitting receiver 43 for fitting therein the fitting 23 during the connected state in which the first and second connectors 2 and 4 are connected to each other. When viewed from the connecting direction in which the first connector 2 connects to the second connector 4, the exterior surface 23*s* of the fitting 23 has four ribs 24 each projecting in a radial direction of the center portion 23*c* of the fitting 23. The interior surface 43*s* of the fitting receiver 43 on the other hand has four recesses 44 for respectively fitting therein the four ribs 24 during the connected state. The four ribs 24, when viewed from the connecting direction, includes two ribs 24 disposed across from each other over the center portion 23*c*, along a single line extending through the center portion 23*c*.

In this structure, the first housing 22 has the tube-like fitting 23 and the second housing 42 has the fitting receiver 43. To connect the first and second connectors 2 and 4 to each other, the first housing 22 is inserted into the second housing 42. The metal latch 5 serves to inhibit separation of the first and second housings 22 and 42 from each other. Further, the four ribs 24 are formed to project from the exterior surface 23*s* of the fitting 23, and the four recesses 44 are formed on the interior surface 43*s* of the fitting receiver 43. Respectively fitting the ribs 24 in the recesses 44 firmly connects the first and second housings 22 and 42 to each other so that rattling does not take place. Each of the four ribs 24 projects in a radial direction, and therefore vibrations in two directions perpendicular to each other (e.g., shaking in the longitudinal and horizontal directions of FIG. 11) when viewed from the connecting direction are simultaneously restrained with a single rib. Further, when viewed from the connecting direction, the four ribs 24 includes two ribs 24 disposed in positions opposing each other across the center portion 23*c* of the fitting 23, along a single line extending through the center portion 23*c*. With these two ribs 24 disposed to oppose each other, the vibrations in two directions perpendicular to each other are effectively restrained with a minimum number of ribs.

Thus, the connected state of the both connectors (first and second connectors 2 and 4) is maintained while reducing an effect from vibration, with a simple structure. Therefore, even if the electric connecting device is subject to vibration, disconnection or a damage due to wear and tear is restrained.

Further, with the structure of the present embodiment, the housing is lightened with the minimum number of the ribs. Therefore, the entire connector is less likely given an adverse effect from vibration. This allows adoption of a metal latch whose resiliently-holding-force is relatively low.

The electric connecting device 1 of the present embodiment is adapted so that: the fitting 23 is formed in the shape of a quadrangular tube; and the four ribs 24 formed on the exterior surface 23*s* of the fitting 23 are respectively disposed at corner portions of the fitting 23. This simplifies the shape of the housing and the positions of the ribs or the recesses.

Further, a metal-latch-mountable connector housing 3 of the present embodiment is used as one of a pair of connectors connectable to each other, and includes: the main body 42*b* connectable to the first connector 2 of the first housing 22, which supports the two second terminals 41 to be respectively connected to the two first terminals 21 of the first connector 2; and a metal latch 5 which inhibits separation of the main body 42*b* and the first housing 22 from each other. The main body 42*b* has a fitting receiver 43 for fitting therein a tube-like fitting 23 formed on the first housing 22, during a connected state in which the pair of connectors are connected to each other. When viewed from a connecting direction in which the pair of connectors connect to each other, the interior surface 43*s* of the fitting receiver 43 has plural ribs 24 each projecting in a radial direction of a center portion 23*c* of the fitting 23. The plural ribs 24 on the interior surface 43*s* of the fitting receiver 43 includes two ribs disposed across from each other over the center portion 23*c*, along a single line extending through the center line 23*c*, when viewed from the connecting direction. With this, the connected state of the both connectors is maintained while reducing an effect from vibration, with a simple structure.

The metal-latch-mountable connector housing 3 of the present embodiment is adapted so that: the fitting 23 is formed in the shape of a quadrangular tube; and the four recesses 44 formed on the interior surface 43*s* of the fitting receiver 43 are respectively disposed in positions corresponding to corner portions of the fitting 23, during the connected state. This simplifies the shape of the housing and the positions of the ribs or the recesses.

The advantageous effects of the electric connecting device 1 and the metal-latch-mountable connector housing 3 of the present embodiment are particularly remarkable when used under an environment where the installation direction of the first housing and a direction of the connector-affecting vibration are determined to a certain extent. For example, suppose that the first connector is installed as illustrated in FIG. 11, and that the main directions of the vibration affecting the first connector are the longitudinal and horizontal directions of FIG. 11. In such a case, effects from vibrations in the longitudinal and horizontal directions of FIG. 11 are efficiently restrained by disposing a rib at each corner position (upper left, upper right, lower left, and lower right in front view) of the fitting as illustrated in FIG. 11. Note that the electric connecting device of the present invention is usable even if the direction of disposing the first housing and the direction of vibration are not certain.

Further, as mentioned above, there is a play between the guide groove 42*v* and the guide projection 22*v*, and between (i) the guide groove 42*x* and (ii) the projection 22*x* and the guide projection 22*w*. However, the ribs 24, supplementary ribs 45, recesses 44, and supplementary recesses 25 are formed, and by closely attaching these parts with little gap therebetween, the first and second connectors 2 and 4 during the connected state are hardly affected by the vibration.

Further, in Embodiment 1, the ribs 24 and the supplementary recesses 25 are formed on the first housing 22, and supplementary ribs 45 and the supplementary recesses 44 are formed on the second housing 42. That is, in Embodiment 1, ribs and recesses are formed on both of the first and second housings 22 and 42. The present invention however is not limited to such a structure, and the supplementary ribs and supplementary recesses do not have to be formed.

Further, in Embodiment 1, the plural ribs 24 are formed on the exterior surface 23*s* of the fitting 23, and the plural recesses 44 are formed on the interior surface 43*s* of the fitting receiver 43. It is however possible to form plural ribs on the interior surface of the fitting receiver, and plural recesses on the exterior surface of the fitting, as opposed to Embodiment 1. In this case, the plural ribs are formed to project in the radial direction of the center portion of the fitting receiver, and the plural ribs on the interior surface of the fitting receiver includes two ribs disposed across from each other over the center portion of the fitting receiver, along a single line extending through the center portion.

(Alternative Forms)

Figure 12:
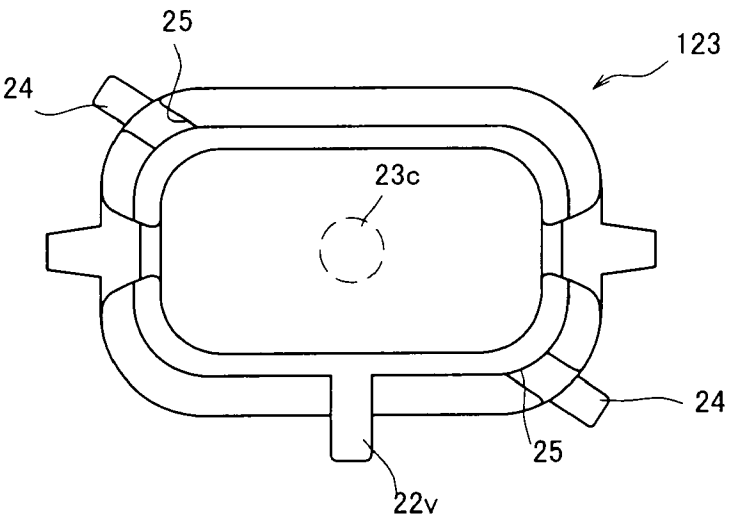
FIG. 12 is a schematic view illustrating alternative forms of the first housing, where FIG. 12(*a*) is a front view illustrating a first alternative form of the first housing, and FIG. 12(*b*) is a front view illustrating a second alternative form of the first housing.
Figure 12:
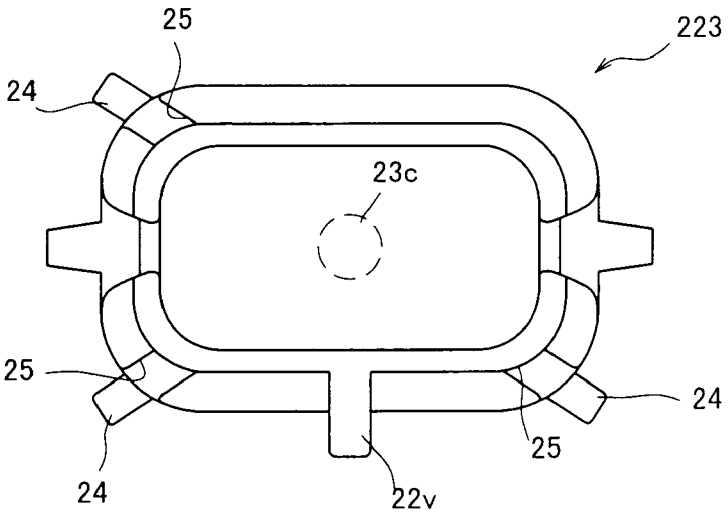

Next, the following describes alternative forms of the electric connecting device of Embodiment 1 according to the present invention, mainly focusing on the difference from the above embodiment. Note that members similar to those of the above embodiment are given the same reference symbols in the drawings, and no further description therefor is provided hereinbelow. FIG. 12 is a schematic view illustrating an alternative form of the first housing, where FIG. 12(*a*) is a front view of a first alternative form of the first housing, and (b) is a front view of a second alternative form of the first housing.

The above embodiment deals with a case where the four ribs 24 are formed on the exterior surface 23*s* of the fitting 23, and four recesses are formed on the interior surface 43*s* of the fitting receiver 43. The respective numbers of the ribs and recesses are not limited to four, provided that the numbers of ribs and recesses are more than one. Specifically, as in the fitting 123 of the first alternative form, the number of ribs 24 may be only two. Alternatively, the number of ribs 24 may be three as in the fitting 223 of the second alternative form. In the first and second alternative forms, the plural ribs formed on the exterior surface of the fitting includes two ribs 24*a* and 24*d* (see FIG. 11) which are disposed across from each other over the center portion 23*c*, along a single line extending through the center portion 23*c*.

Embodiment 2

Figure 13:
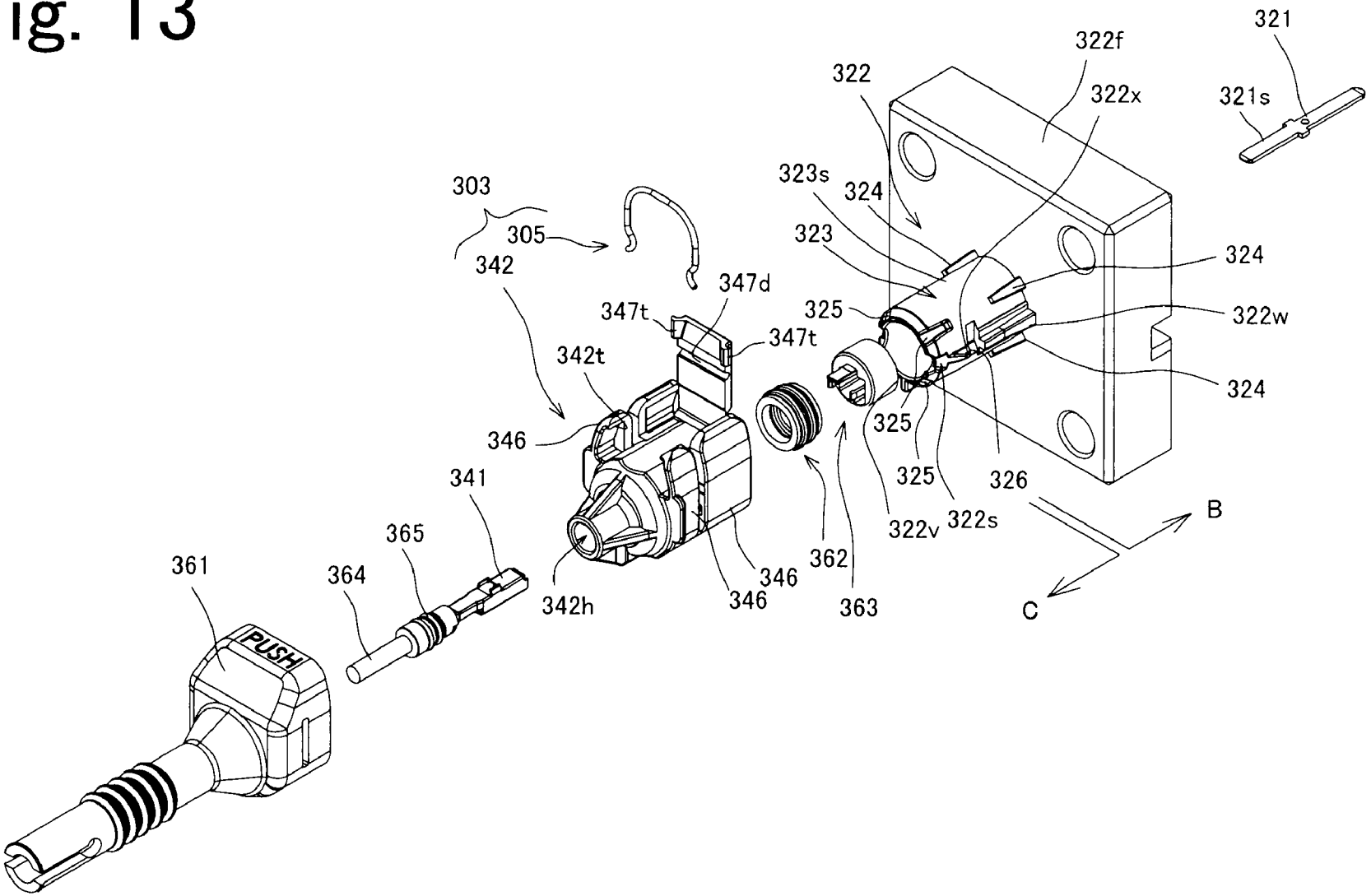
FIG. 13 is an exploded perspective view illustrating parts constituting an electric connecting device of Embodiment 2, according to the present invention.

Next, the electric connecting device of Embodiment 2, according to the present invention is described below, mainly focusing on the difference from the above embodiment. Note that the members that are similar to those of the above embodiment are given the same reference symbols and no further explanation is provided hereinbelow. Further, in the present embodiment, members and parts given the reference symbols 303, 305, 321, 321*s*, 322, 322*f*, 322*s*, 322*v*, 322*w*, 322*x*, 323, 323*s*, 324, 325, 326, 341, 342, 342*h*, 342*t*, 346, 347, 347*d*, 347*t*, 364, and 365 respectively correspond to the members and parts of the foregoing embodiment given the reference symbols 3, 5, 21, 21*s*, 22, 22*f*, 22*s*, 22*v*, 22*w*, 22*x*, 23, 23*s*, 24, 25, 26, 41, 42, 42*h*, 42*t*, 46, 47, 47*d*, 47*t*, 64, and 65. The respective functions of these members and parts are the same as the foregoing embodiment. FIG. 13 is an exploded perspective view illustrating members constituting an electric connecting device of Embodiment 2, according to the present invention.

The present embodiment deals with an electric connecting device whose fitting 323 of the first housing 322 is formed in a cylindrical shape. The four ribs 324 formed on the exterior surface 323*s* of the fitting 323 are disposed at an equal interval in a circumferential direction of the exterior surface 323*s* of the fitting 323, when viewed from the connecting direction. Similarly, the four supplementary recesses 325 formed on the exterior surface 323*s* are disposed at an equal interval in a circumferential direction of the exterior surface 323*s*, when viewed from the connecting direction. Although no illustration is provided, the fitting receiver of the second housing 342 is formed so as to accommodate therein the fitting 323. Specifically, the interior surface of the fitting receiver has not-illustrated four supplementary recesses for respectively fitting therein the four ribs 324, and not-illustrated four supplementary ribs to fit in the four supplementary recesses 325.

Further, the electric connecting device of the present embodiment includes a single first terminal 321 and a single second terminal 341, and is structured as a unipole connector. The electric connecting device and the metal-latch-mountable connector housing may be structured in this way. Note that the reference numeral 361 indicates a rubber boot.

The electric connecting device of the present embodiment is adapted so that: the fitting 323 is formed in a cylindrical shape, and the four ribs 324 formed on the exterior surface 323*s* of the fitting 323 is disposed at an equal interval in a circumferential direction of the fitting 323 when viewed from the connecting direction. This simplifies the shape of the housing, and the positions of the ribs.

The metal-latch-mountable connector housing 303 of the present embodiment is adapted so that: the fitting 323 is formed in a cylindrical shape, and the four recesses formed on the interior surface of the fitting receiver is disposed at an equal interval in a circumferential direction of the fitting receiver when viewed from the connecting direction. This simplifies the shape of the housing, and the positions of the recesses.

Embodiment 3

Figure 14:
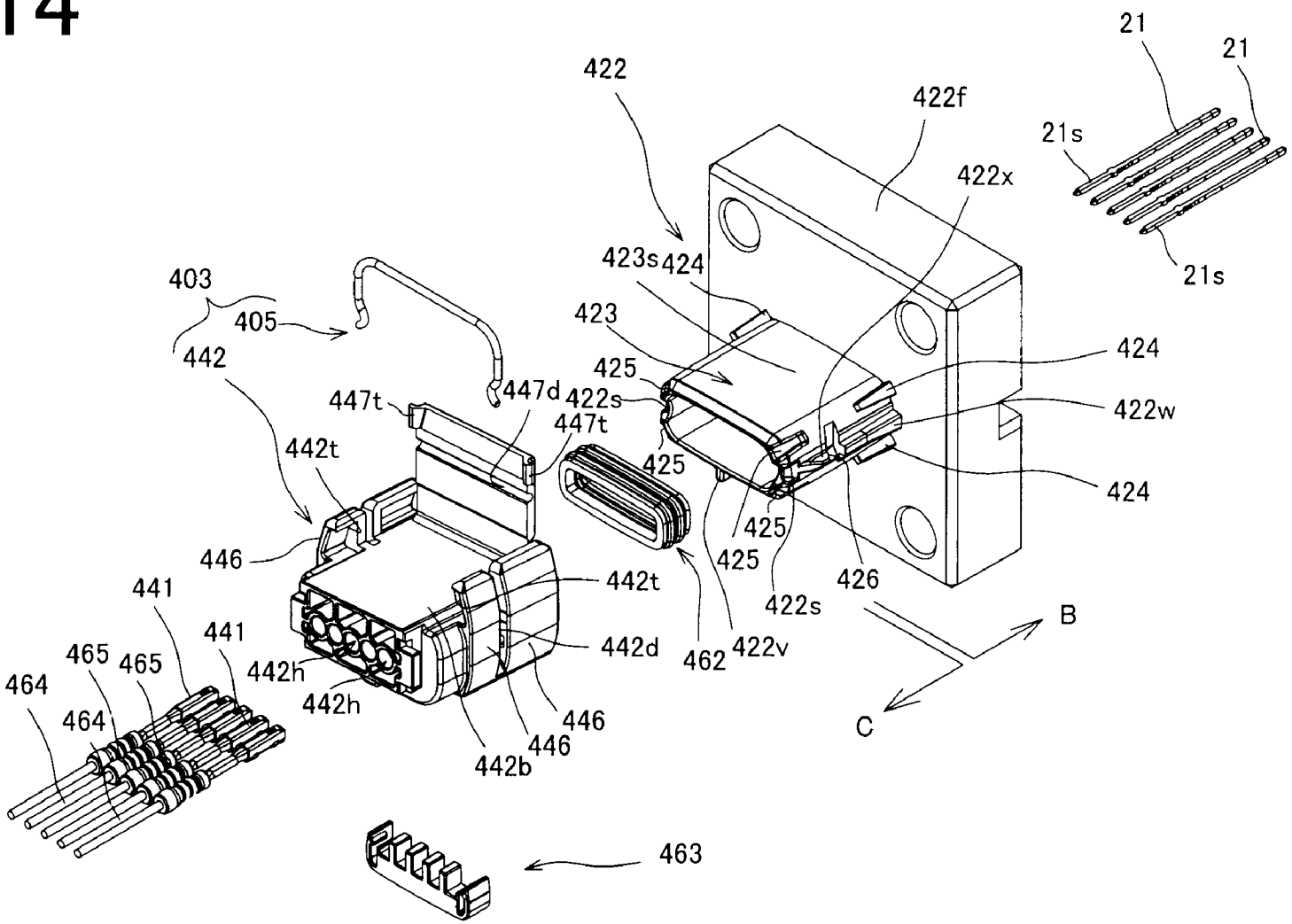
FIG. 14 is an exploded perspective view illustrating parts constituting an electric connecting device of Embodiment 3, according to the present invention.

Next, the electric connecting device of Embodiment 3 according to the present invention is described below, mainly focusing on the difference from the above embodiment. Note that the members that are similar to those of the above embodiment are given the same reference symbols and no further explanation is provided hereinbelow. Further, in the present embodiment, members and parts given the reference symbols 403, 405, 422, 422*f*, 422*s*, 422*v*, 422*w*, 422*x*, 423, 423*s*, 424, 425, 426, 441, 442, 442*h*, 442*t*, 446, 447, 447*d*, 447*t*, 464, and 465 respectively correspond to the members and parts of the foregoing embodiment given the reference symbols 3, 5, 21, 21*s*, 22, 22*f*, 22*s*, 22*v*, 22*w*, 22*x*, 23, 23*s*, 24, 25, 26, 41, 42, 42*h*, 42*t*, 46, 47, 47*d*, 47*t*, 64, and 65. The respective functions of these members and parts are the same as the foregoing embodiment. FIG. 14 is an exploded perspective view illustrating members constituting an electric connecting device of Embodiment 3 according to the present invention.

An electric connecting device of the present embodiment has five first terminals 21 and five second terminals 441, and is structured as a five pole connector. The electric connecting device may be structured in this way.

Embodiment 4

Figure 15:
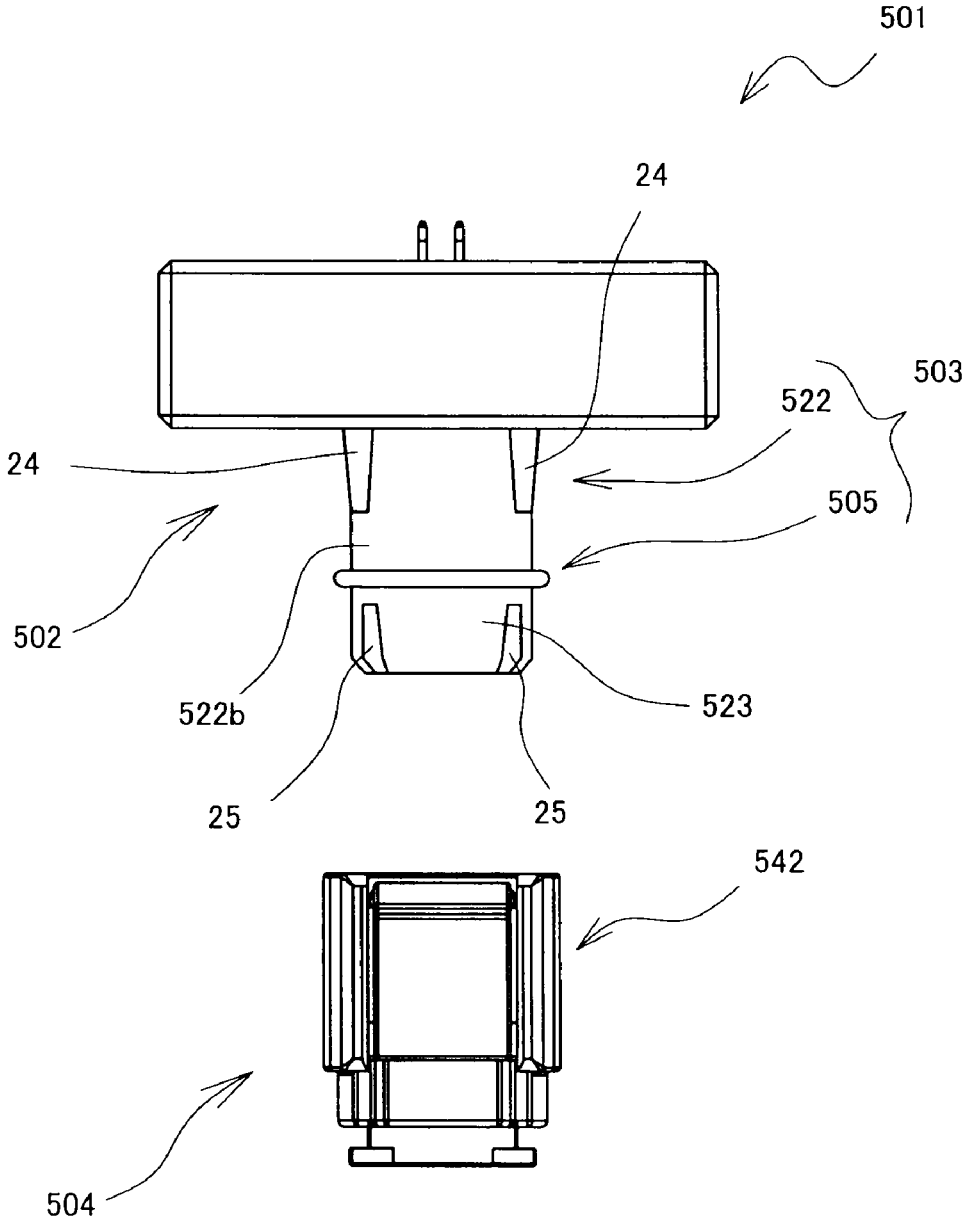
FIG. 15 is plane view illustrating an electric connecting device of Embodiment 4, according to the present invention.

Next, the electric connecting device of Embodiment 4 according to the present invention is described below, mainly focusing on the difference from the above embodiment. Note that the members that are similar to those of the above embodiment are given the same reference symbols and no further explanation is provided hereinbelow. Further, in the present embodiment, members and parts given the reference symbols 501, 502, 503, 504, 505, 522, and 523 respectively correspond to the members and parts of the foregoing embodiments given the reference symbols 1, 2, 3, 4, 5, 22, and 23. The respective functions of these members and parts are the same as the foregoing embodiment. FIG. 15 is a plane view illustrating an electric connecting device of Embodiment 4 according to the present invention.

An electric connecting device 501 of the present embodiment differs from Embodiment 1 in that, for example, a metal latch 505 is mounted to the first housing 522, and no metal latch is mounted to the second housing 542. Unlike the above mentioned embodiment, the present embodiment deals with a case where a metal-latch-mountable connector housing 503 has a main body 522*b* of the first housing 522 and the metal latch 505. Separation of the first and second housings 522 and 542 from each other is inhibited by latching the metal latch 505 on a not-illustrated latch receiver formed on the interior surface of the second housing 542. In the foregoing embodiment, the metal latch 5 tries to restore its original state by shrinking during the connecting operation. In the present embodiment however, the metal latch 505 once having been shrunk tries to restore its original state by expanding. This force to expand inhibits separation of the first and second housings 522 and 542 from each other. The electric connecting device may be structured in this way.

The metal-latch-mountable connector housing 503 of the present embodiment is for one of a pair of connectors connectable to each other, and includes: a main body 522*b* connectable to a second connector (counterpart connector) 504 of a second housing (counterpart housing) 542, which supports a connector terminal electrically connectable to a second terminal (counterpart terminal) of the second connector 504; and a metal latch 505 which inhibits separation of the main body 522*b* and the second housing 542 from each other. The main body 522*b* is formed as a tube-like fitting 523 to fit in a fitting receiver formed on the second housing 542, during a connected state in which the pair of connectors are connected to each other. When viewed from a connecting direction in which the pair of connectors connect to each other, the exterior surface of the fitting 523 has (i) plural ribs 24 each projecting in a radial direction of a center portion of the fitting 523. The plural ribs 24 on the exterior surface of the fitting 523 includes two ribs 24 disposed across from each other over the center portion, along a single line extending through the center line, when viewed from the connecting direction. With this, the connected state of the both connectors is maintained while reducing an effect from vibration, with a simple structure.

The metal-latch-mountable connector housing 503 of the present embodiment is adapted so that: the fitting 523 is formed in the shape of a quadrangular tube; and the four ribs 24 are respectively disposed at corner portions of the fitting 523. This simplifies the shape of the housing and the positions of the ribs or the recesses.

Note that the shape of the fitting is not limited to the above, and for example, the fitting may be formed in a cylindrical shape (see Embodiment 2 for the shape of fitting). In such a case, the plural ribs on the exterior surface of the fitting may include two to four ribs which are disposed at an equal interval in a circumferential direction of the fitting, when viewed from the connecting direction. This also simplifies the shape of the housing and the positions of the ribs or the recesses. Note that it is possible to form plural recesses on the exterior surface of the fitting, and form plural ribs on the interior surface of the fitting receiver.

It should be noted that the present invention shall not be limited to the embodiments thus described, and various modifications are possible within the scope of the present invention.

For example, each of the above embodiments deals with a case where the electric connecting device is used as an equipment-use connector for supplying power. However, the electric connecting device may be used as an equipment-use connector for transmitting/receiving electric signals. The use of the electric connecting device is not limited to equipment, and the electric connecting device may be used for a relay or a substrate.

Further, the electric connecting device is not limited to one such that the second connector is connected to the first connector which is fixed, and the electric connecting device may be such that the first connector is connected to the second connector which is fixed.

Further, the shape of the fitting may be formed in a shape other than the shapes mentioned above. For example, the fitting may be formed in such a tube-like shape whose cross section is a polygon such as triangle or pentagon.

Further, the metal latch is not particularly limited, provided that the metal latch is mountable to a housing of one of a pair of connectors connectable to each other.

Further, Embodiment 1 deals with a case where the cover 47 and the metal latch 5 contact each other during the covering state. However, the cover 47 does not have to contact the metal latch 5 during the covering state. When the cover 47 and the metal latch 5 contact each other as in the present embodiment, the metal latch 5 and the second housing 42 needs to have therebetween a certain play (which enables restoration of the metal latch 5 from its resilient deformation is not inhibited) so that a clicking feel is given at the time of locking operation.

Figure 16:
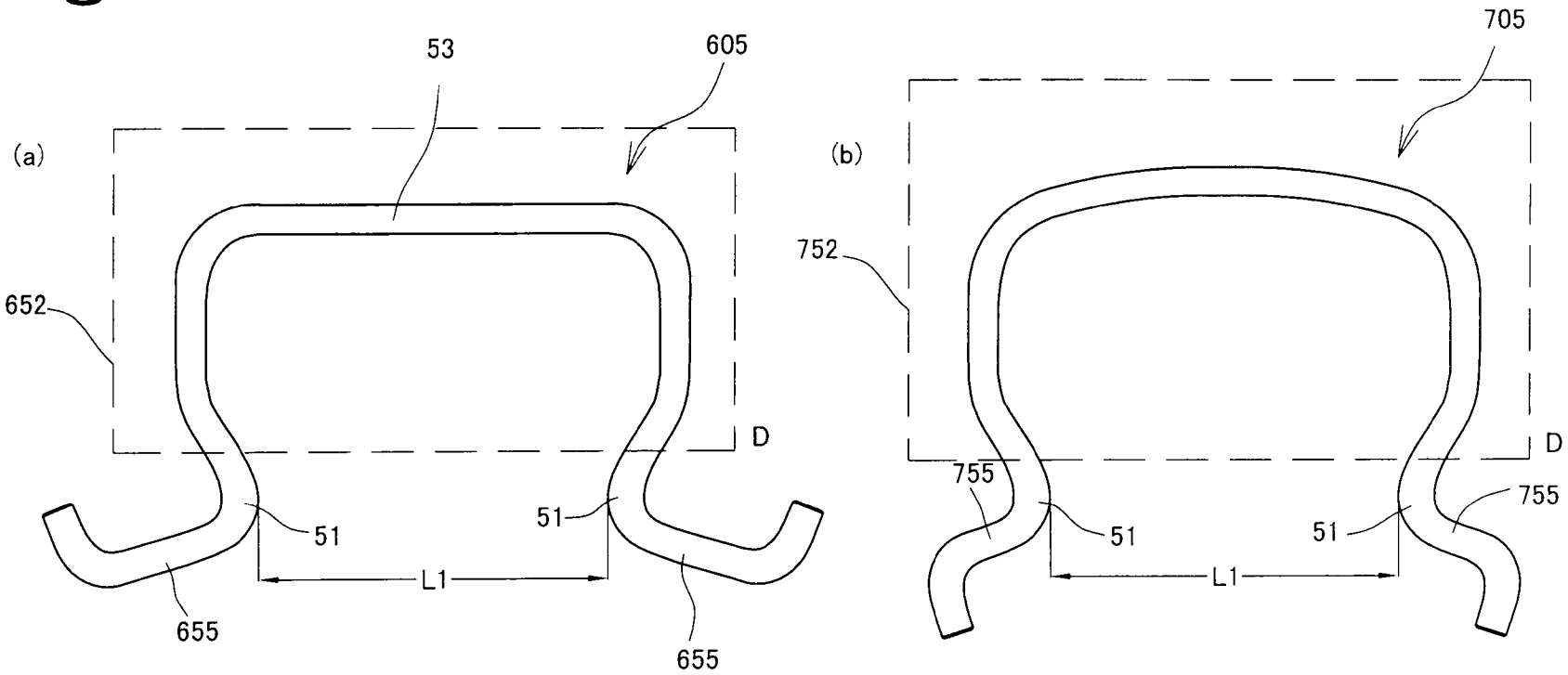
FIG. 16 is a front view showing alternative forms of the metal latch, where FIG. 16(*a*) illustrates a third alternative form and FIG. 16(*b*) illustrates a fourth alternative form.

Further, the metal latch is preferably formed so that only the latch main portion (see latch main portion 52 surrounded by the frame of FIG. 10(*b*)) has a C-shape or U-shape. The shape of the tip portions of the metal latch is not particularly limited. That is, the entire metal latch may have a shape which may not be referred to as a C-shape or U-shape, as illustrated in FIGS. 16(*a*) and 16(*b*). Note that portions given the reference numerals 605, 652, and 655 in FIGS. 16(*a*) and 16(*b*) respectively correspond to the portions of the foregoing embodiment given the reference numerals 5, 52, and 55. Likewise, portions given the reference numerals 705, 752, and 755 respectively correspond to portions of the foregoing embodiment given the reference numerals 5, 52, and 55.

Further, the connection sloping surfaces 22*s* and the unlocking sloping surfaces 42*p* may be omitted. Further, the guide projections 22*w*, guide projection 22*v*, guide grooves 42*x*, and guide groove 42*v* may be omitted. Further, the side recess 27, fitting recess 22*m*, and fitting projection 42*m* may be omitted. Further, the shape of the terminals in the present embodiment are solely to serve as examples, and the shape of the terminals are not limited to those of the above embodiment. For example, the terminals are structured so that the second terminal is inserted into the first terminal, as opposed to the present embodiment. Further, the cover 47 and the groove 42*d* may be omitted.

Further, the above embodiments deal with a case where the metal latch is formed by curving a single rod-like member. The metal latch 5 however is not limited to this, and for example, it is possible to form the metal latch 5 by bending a plate member.

Further, the material of the latch is not limited, and plastic or the like may be adopted as the material of the latch.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An electric connecting device, comprising:

a first connector having a first terminal and a first housing supporting the first terminal;

a second connector having a second terminal electrically connectable to the first terminal and a second housing supporting the second terminal; and a latch which inhibits separation of the first and second housings from each other, wherein the first housing has a tube-like fitting and the second housing has a fitting receiver for fitting therein the fitting during a connected state in which the first and second connectors are connected to each other, when viewed from a connecting direction in which the first connector connects to the second connector, one of an exterior surface of the fitting and an interior surface of the fitting receiver has plural first ribs each projecting in a radial direction of a center portion of the fitting, and the other one of the exterior surface of the fitting and the interior surface of the fitting receiver has plural first recesses for respectively fitting therein the first ribs during the connected state, the first ribs, when viewed from the connecting direction, includes two ribs disposed across from each other over the center portion, along a single line extending through the center portion, on the exterior surface of the fitting or the interior surface of the fitting receiver;

when viewed from the connecting direction, the other one of the exterior surface of the fitting and the interior surface of the fitting receiver has plural second ribs each projecting in a radial direction of a center portion of the fitting, and the one of the exterior surface of the fitting and the interior surface of the fitting receiver has plural second recesses for respectively fitting therein the second ribs during the connected state.

2. The electric connecting device according to claim 1, wherein:

the fitting is formed in the shape of a quadrangular tube; and the plural first ribs or the plural first recesses formed on the exterior surface of the fitting includes two to four ribs or two to four recesses which are respectively disposed at corner portions of the fitting.

3. The electric connecting device according to claim 1, wherein:

the fitting is formed in a cylindrical shape; and the plural first ribs or the plural first recesses formed on the exterior surface of the fitting includes two to four ribs or two to four recesses which are disposed at an equal interval in a circumferential direction of the fitting when viewed from the connecting direction.

4. A latch-mountable connector housing for one of a pair of connectors connectable to each other, comprising:

a main body connectable to a counterpart connector of a counterpart housing, which supports a connector terminal electrically connectable to a counterpart terminal of the counterpart connector; and a latch which inhibits separation of the main body and the counterpart housing from each other, wherein the main body has a fitting receiver for fitting therein a tube-like fitting formed on the counterpart housing, during a connected state in which the pair of connectors are connected to each other, when viewed from a connecting direction in which the pair of connectors connect to each other, an interior surface of the fitting receiver has (i) plural first ribs each projecting in a radial direction of a center portion of the fitting, or (ii) plural first recesses each formed in a radial direction, the plural first ribs or the plural first recesses on the interior surface of the fitting receiver includes two ribs or two recesses disposed across from each other over the center portion, along a single line extending through the center line, when viewed from the connecting direction, and when viewed from the connecting direction, the interior surface of the fitting receiver has (iii) plural second ribs each projecting in a radial direction of the center portion of the fitting in the case that the interior surface has the plural first recesses, or (iv) plural second recesses each formed in a radial direction in the case that the interior surface has the plural first ribs.

5. The latch-mountable connector housing according to claim 4, wherein:

the fitting is formed in the shape of a quadrangular tube; and the plural first ribs or the plural first recesses formed on the interior surface of the fitting receiver includes two to four ribs or two to four recesses which are respectively disposed in positions corresponding to corner portions of the fitting, during the connected state.

6. The latch-mountable connector housing according to claim 4, wherein:

the fitting is formed in a cylindrical shape; and the plural first ribs or the plural first recesses formed on the interior surface of the fitting receiver include two to four ribs or two to four recesses which are disposed at an equal interval in a circumferential direction of the fitting receiver when viewed from the connecting direction.

7. A latch-mountable connector housing for one of a pair of connectors connectable to each other, comprising:

a main body connectable to a counterpart connector of a counterpart housing, which supports a connector terminal electrically connectable to a counterpart terminal of the counterpart connector; and a latch which inhibits separation of the main body and the counterpart housing from each other, wherein the main body is formed as a tube-like fitting to fit in a fitting receiver formed on the counterpart housing, during a connected state in which the pair of connectors are connected to each other, when viewed from a connecting direction in which the pair of connectors connect to each other, an exterior surface of the fitting has (i) plural first ribs each projecting in a radial direction of a center portion of the fitting or (ii) plural first recesses each formed in a radial direction, the plural first ribs or the plural first recesses on the exterior surface of the fitting includes two ribs or two recesses disposed across from each other over the center portion, along a single line extending through the center line, when viewed from the connecting direction, and when viewed from the connecting direction in which the pair of connectors connect to each other, the exterior surface of the fitting has (iii) in the case of plural first recesses, plural second ribs each projecting in a radial direction of the center portion of the fitting in the case that the interior surface has the plural first recesses, or (iv) in the case of plural first ribs, plural second recesses each formed in a radial direction in the case that the interior surface has the plural first ribs.

8. The latch-mountable connector housing according to claim 7, wherein:

the fitting is formed in the shape of a quadrangular tube; and the plural first ribs or the plural first recesses includes two to four ribs or two to four recesses which are respectively disposed at corner portions of the fitting.

9. The latch-mountable connector housing according to claim 7, wherein:

the fitting is formed in a cylindrical shape; and the plural first ribs or the plural first recesses formed on the exterior surface of the fitting includes two to four ribs or two to four recesses which are disposed at an equal interval in a circumferential direction of the fitting when viewed from the connecting direction.

* * * * *